US009688451B2

(12) United States Patent
Kapolas

(10) Patent No.: US 9,688,451 B2
(45) Date of Patent: Jun. 27, 2017

(54) COMPOSITE CLOSURE WITH SEAL INDICATING PANEL

(71) Applicant: William J. Kapolas, Palatine, IL (US)

(72) Inventor: William J. Kapolas, Palatine, IL (US)

(73) Assignee: SILGAN WHITE CAP LLC, Downers Grove, IL (US)

( * ) Notice: Subject to any disclaimer, the term of this patent is extended or adjusted under 35 U.S.C. 154(b) by 1170 days.

(21) Appl. No.: 13/768,494

(22) Filed: Feb. 15, 2013

(65) Prior Publication Data

US 2013/0205718 A1 Aug. 15, 2013

Related U.S. Application Data

(60) Provisional application No. 61/599,297, filed on Feb. 15, 2012.

(51) Int. Cl.

| | |
|---|---|
| ***B65D 45/30*** | (2006.01) |
| ***B65D 79/00*** | (2006.01) |
| ***B65D 51/14*** | (2006.01) |

(52) U.S. Cl.

CPC ..... *B65D 79/005* (2013.01); *B65D 45/30* (2013.01); *B65D 51/145* (2013.01)

(58) Field of Classification Search

CPC ..... B65D 79/005; B65D 45/30; B65D 51/145
USPC ..... 215/276, 349–351
See application file for complete search history.

(56) References Cited

U.S. PATENT DOCUMENTS

| | | | | |
|---|---|---|---|---|
| 2,449,014 | A * | 9/1948 | Shaffer | B65D 51/145 116/200 |
| 6,375,023 | B1 * | 4/2002 | Lecinski | B65D 51/145 215/253 |
| 6,662,958 | B2 | 12/2003 | German et al. | |
| 7,134,565 | B1 | 11/2006 | Wan et al. | |
| 7,175,039 | B2 | 2/2007 | German et al. | |
| 7,784,629 | B2 | 8/2010 | German et al. | |
| 2003/0141271 | A1 * | 7/2003 | German | B65D 51/145 215/252 |

* cited by examiner

*Primary Examiner* — James N Smalley
(74) *Attorney, Agent, or Firm* — Reinhart Boerner Van Deuren s.c.

(57) ABSTRACT

A composite closure including a panel and an outer portion defining a recess into which the panel is received. The composite closure may be coupled with a container. The panel deflects downward toward the container when the composite closure is sealed with the container and the interior of the container is under vacuum.

17 Claims, 19 Drawing Sheets

COMPOSITE CLOSURE WITH SEAL INDICATING PANEL

CROSS-REFERENCE TO RELATED PATENT APPLICATION

This application claims the benefit of U.S. Provisional Application No. 61/599,297, filed Feb. 15, 2012, which is incorporated herein by reference in its entirety.

BACKGROUND OF THE INVENTION

The application generally relates to composite closures. More specifically, the application relates to composite closures to close containers that store a variety of materials, such as perishable food items, with interiors kept under vacuum prior to opening.

SUMMARY OF THE INVENTION

In one embodiment, a composite closure configured to seal a container defining an interior under vacuum is provided. The composite closure includes an outer portion. The outer portion includes an annular top portion. The outer portion also includes a skirt coupled to and extending downwardly from the annular top portion. The skirt has an interior surface, an exterior surface, and preformed threading extending from the interior surface. The composite closure also includes a panel. The panel is configured to be received within the outer portion. The panel includes an outer annular raised portion. The panel also includes an angular transition portion extending inwardly from the outer annular raised portion. The panel also includes a generally flat portion extending inwardly from the angular transition portion. The panel also includes a raised central portion, rising above the generally flat portion. The raised central portion includes an outer portion extending from the generally flat portion. The outer portion has a first slope. The raised central portion also includes a central portion extending from the outer portion. The central portion has a second slope. When the closure seals the container with an internal vacuum, the raised central portion is configured to move downwardly from a first position above the generally flat portion to a second position at which the central portion is below the generally flat portion. The raised central portion is configured to return from the second position to the first position without generating an audible sound when the seal between the composite closure and the container is broken and the interior of the container returns to an ambient pressure.

In another embodiment, a composite closure configured to seal a container having an interior under vacuum is provided. The composite closure includes an outer portion formed from a first material. The outer portion includes a skirt extending generally transversely from a ring. The skirt includes an interior surface and an exterior surface. The skirt defines threading on the interior surface. The threading is configured to threadingly engage the container. The composite closure also includes a panel. The panel has a raised portion proximate its exterior. The panel also has a generally flat portion coupled with and arranged radially interior of the raised portion. The panel also has a raised central portion coupled with, arranged radially interior to, and sloping upwardly from the flat portion. The panel has a first diameter measured from the peripheral edge of the generally flat portion. The raised central portion has a center and a second diameter. The ratio of the second diameter to the first diameter is between about 50% and 80%. The center of the raised central portion is arranged at least 0.010 inches vertically above the flat portion in a first position. The panel is configured such that the raised central portion is configured to deflect downwardly to a second position when the composite closure is sealed to a container the interior of which is under vacuum of at least 4 inches of Hg. The center of the raised central portion in the second position is arranged at least 0.025 inches vertically downwardly from the center of the raised central portion in the first position.

In another embodiment, a method of inspecting closure sealing of a container with an internal vacuum is provided. The method includes filling the container with a product. The method also includes providing a composite closure. The composite closure includes a plastic outer portion having a central cavity. The composite closure also includes a metal panel portion received within the central cavity of the outer portion. The panel portion includes a horizontal outer panel section. The panel portion also includes a central raised portion. The central raised portion has a first position extending above the outer panel section. The central raised portion is configured to move downward from the first position to a second position below the horizontal outer panel section when the closure seals the container. The method also includes attaching the composite closure to the container. The method also includes forming a vacuum within the container. The vacuum of the container causes the central raised portion to move downward from the first position to a second position below the horizontal outer section. The method also includes detecting the position of the central raised portion. The method also includes determining whether the container is sealed by the closure based on the detected position of the central raised portion.

In another embodiment, a composite closure configured to seal a container having an interior under vacuum is provided. The composite closure includes a panel. The panel is configured such that at least a portion of the panel deflects downwardly from a first configuration to a second configuration toward the container when the composite closure seals the container having an interior under vacuum. The panel is configured such that it does not have snap-through when transitioning downwardly from the first position to the second position. Additionally, the panel is configured such that when the composite closure is no longer sealing the container having an interior under vacuum or when the interior of the container is no longer under vacuum, at least a portion of the panel deflects upwardly away from the container from the second position to the first position. The panel is configured such that it does not have snap-through when transitioning upwardly from the second position to the first position.

In another embodiment, a composite closure configured to seal a container defining an interior under vacuum is provided. The composite closure includes an outer portion. The outer portion includes an annular top portion and a skirt coupled to and extending downward from the annular top portion. The skirt has an interior surface, an exterior surface, and preformed threading extending from the interior surface. The composite closure also includes a panel configured to be received within the outer portion. The panel includes an outer annular raised portion. The panel includes an angular transition portion extending radially inwardly from the outer annular raised portion. The panel includes a central deflection portion. The central deflection portion includes an outer portion extending angularly upwardly and radially inwardly from the angular transition portion. The central deflection portion includes a raised central portion. The raised central portion is generally above the outer portion. The raised central portion extends radially inwardly from the outer portion. The raised central portion has a first slope. When the composite closure seals the container with an internal vacuum, the central deflection portion is configured to move downwardly from a first position to a second position. The central deflection portion is configured to return from the second position to the first position without generating an audible sound when the seal between the composite closure and the container is broken and the interior of the container returns to an ambient pressure.

In another embodiment, a composite closure configured to seal a container having an interior under vacuum is provided. The composite closure includes an outer portion formed from a first material including a skirt extending generally downward from a ring. The skirt has an interior surface and an exterior surface. The skirt defines threading on the interior surface configured to threadingly engage the container. The composite closure includes a panel formed from a second material. The panel includes a raised outer portion proximate the radial exterior of the panel. The panel includes a first sloped portion coupled to and arranged radially inwardly from the raised portion. The panel includes a raised central portion coupled to, configured above and radially inwardly from the first sloped portion. The panel has a first diameter measured at the radial peripheral edge of the first sloped portion. The raised central portion has a center point. The raised central portion has a radially outer peripheral edge. The raised central portion has a second diameter measured at the radially outer peripheral edge of the raised central portion. The ratio of the second diameter to the first diameter is between approximately 30% and approximately 80%. The center of the raised central portion is arranged at least approximately 0.01 inches vertically above the radial peripheral edge of the first sloped portion. The panel is configured such that the raised central portion is configured to deflect downwardly to a second position when the composite closure is sealed to a container the interior of which is under vacuum of at least 8 inches of Hg. The center point of the raised central portion in the second position is configured at least approximately 0.025 inches vertically downwardly from the center point of the raised central portion in the first position.

In another embodiment, a method of inspecting closure sealing of a container with an internal vacuum is provided. The method includes filling the container with a product. The method includes providing a composite closure. The composite closure includes a plastic outer portion with a central cavity. The composite closure includes a metal panel portion received within the central cavity of the outer portion. The panel portion includes an outer panel section and a central raised portion having a first position above the outer panel section. The central raised portion is configured to move downwardly from the first position to a second lower position when the closure seals the container. The method includes attaching the composite closure to the container. The method includes forming a vacuum within the container. The vacuum in the container causing the central raised panel portion to move downward from the first position to the second lower position. The method includes detecting the position of the central raised portion. The method includes determining whether the container is sealed by the closure based on the detected position of the central raised portion.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, a composite closure is provided. The composite closure is generally configured to seal containers, the interiors of which are under vacuum. In various embodiments, composite closures include a portion which deflects downwardly, indicating that the interior of the container is under vacuum and that the composite closure is properly sealing the container. The deflected portion may be inspected to verify proper sealing. Embodiments of the composite closure provide deflection characteristics that allow for easy inspection. Specifically, in various embodiments, the composite closure includes a metal panel that includes a raised central portion that deflects a significant amount under vacuum when applied to a plastic or semi-rigid container or a glass or rigid container. The raised central panel is positioned and shaped to provide deflection that may be detected during processing to confirm that proper container sealing has occurred. The raised panel is also positioned and shaped to limit or avoid "snap-through" upon container opening that may be present in tamper-evident closures.

Figure 1:
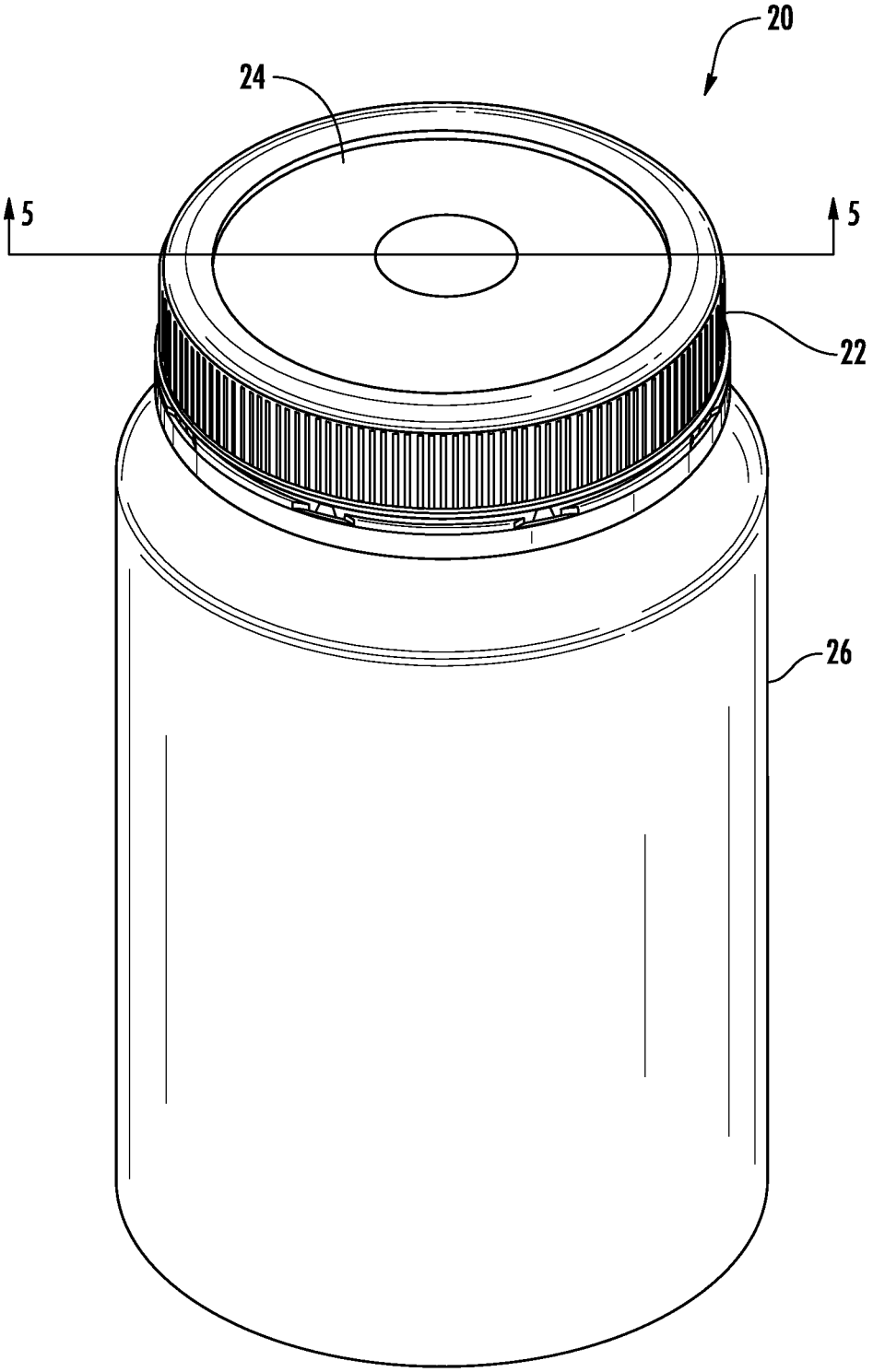
FIG. 1 is a perspective view of an exemplary embodiment of a composite closure.

Referring to FIG. 1, an embodiment of a composite closure 20 is illustrated. The composite closure 20 includes an outer closure portion 22 and a panel 24. The composite closure 20 is illustrated coupled with an exemplary container 26. In one embodiment, the annular outer closure portion 24 is formed from plastic.

In one embodiment, the composite closure 20 is configured to close containers formed from any suitable type of plastic. Closure of containers formed from other suitable types of materials may be used. In one embodiment, the composite closure 20 is configured to close and seal containers, the interiors of which are kept under vacuum prior to opening the composite closure 20 and breaking the seal with the container. As will be explained further below, at least a portion of the panel 24 will deflect downwardly towards the container 26 when the composite closure 20 seals a container 26 the interior of which is under vacuum. The downward deflection of the panel 24 indicates that the composite closure 20 is sealed to the container 26, that the interior of the container 26 is under vacuum, and that the composite closure 20 has not been opened.

Figure 2:
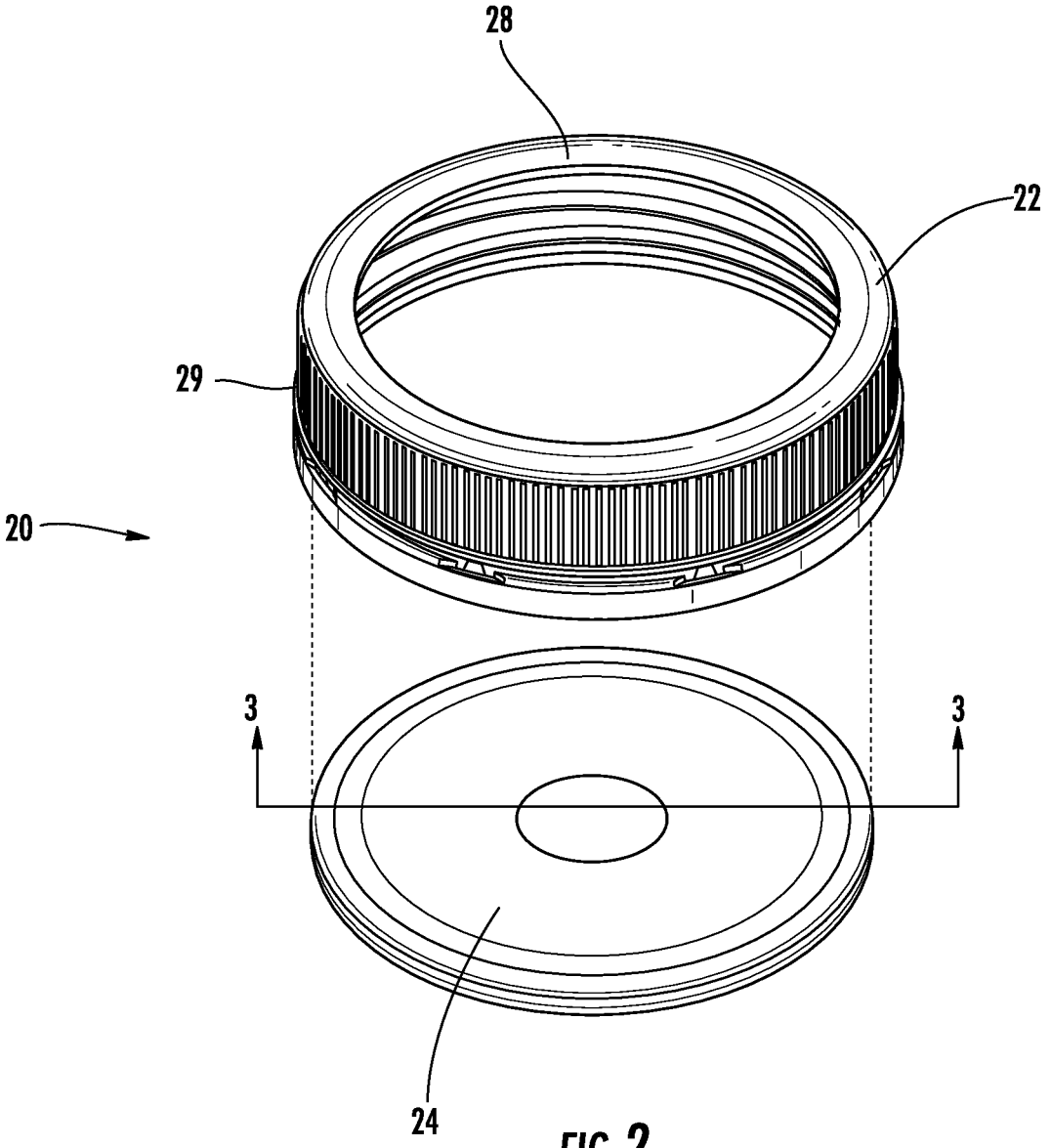
FIG. 2 is an exploded view of the composite closure of FIG. 1 including a panel according to an exemplary embodiment.

With reference to FIG. 2, the outer closure portion 22 includes an annular top portion 28 extending generally parallel with the panel 24 and a skirt portion 29 extending generally perpendicular downwardly from the peripheral edge of the annular top portion 28. As is illustrated in FIG. 2, in one embodiment the panel 24 is selectively detachable from the outer closure portion 22. The skirt portion 29 defines a cavity or chamber that is sized to receive the panel 24 therein. Various retention mechanisms, such as, for example, press-fit, interference fit, snap-fit, etc., may be used to temporarily maintain the panel 24 within the annular top portion 28. In one embodiment, the panel 24 is permanently or semi-permanently retained within the outer closure portion 22.

Figure 3:
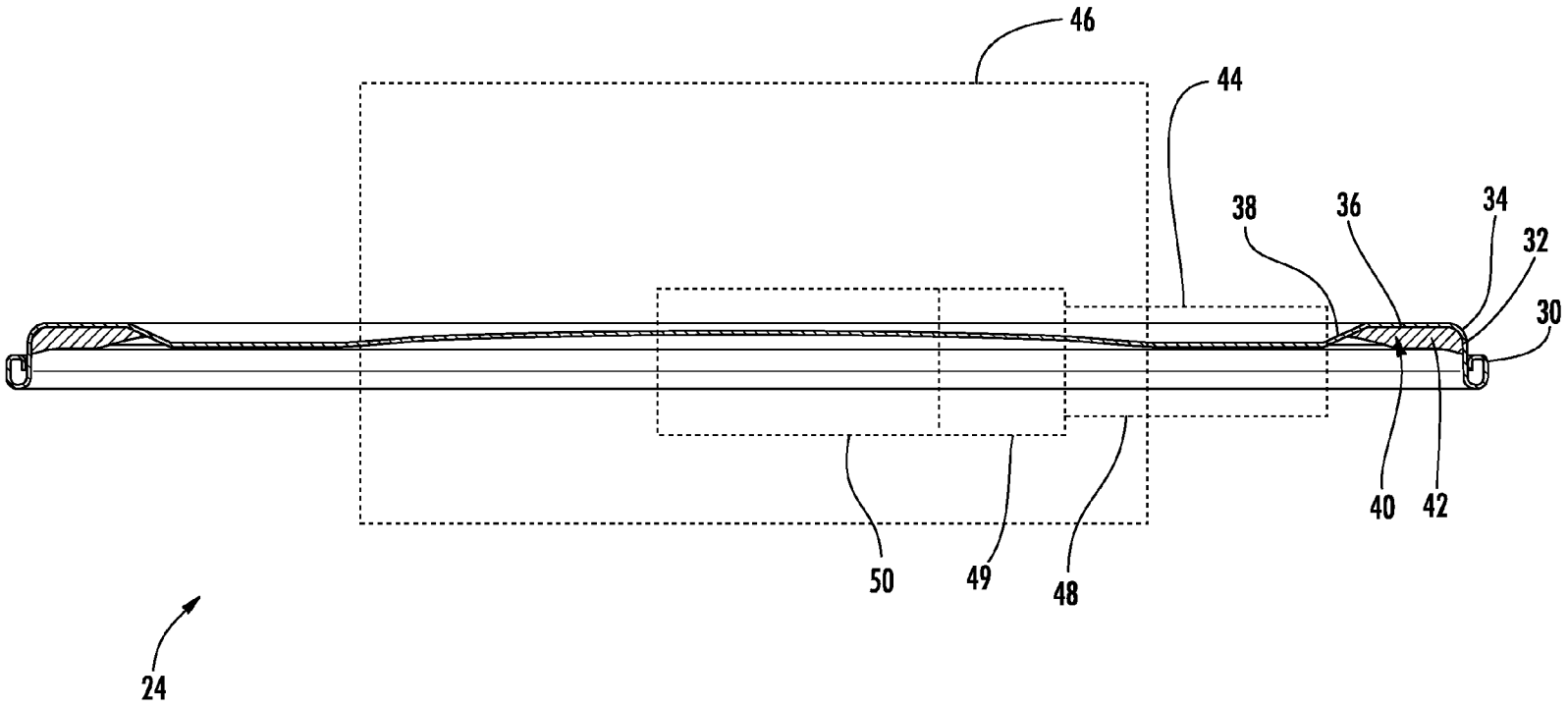
FIG. 3 is a sectional view of the panel of the composite closure of FIG. 1 taken along section line 3-3 in FIG. 2 according to an exemplary embodiment.

With reference to FIG. 3, a sectional view of the panel 24 taken along the line 3-3 in FIG. 2 is illustrated. The panel 24 includes an outer curl 30. In one embodiment, the outer curl 30 may be configured to interface with the outer closure portion 22 to releasably, semi-permanently, or permanently join the panel 24 with the out closure portion 22.

Extending from the curl 30 is an outer, generally vertical wall portion 32. The generally vertical wall portion 32 extends upwardly away from the curl 30 to a transition portion 34. Transition portion 34 provides a rounded shoulder that couples the generally vertical wall portion 32 to an outer annular raised portion, shown as raised horizontal portion 36. Transition portion 34 provides the transition from vertical wall portion 32 to the raised horizontal portion 36. Horizontal portion 36 extends radially inwardly from the generally vertical wall portion 32 to an angular transition portion 38. The angular transition portion 38 extends at a non-right angle (i.e., a non-right angle relative to the longitudinal or vertical axis of the closure) radially inward and downward from the raised horizontal portion 36. The angular transition portion 38, the raised horizontal portion 36 and the generally vertical wall portion 32 form between them on the underside of the panel 24 an annular channel 40.

In one embodiment, disposed in the annular channel 40 is a sealing element 42. The panel 24 is arranged and configured such that when the composite closure 20 is coupled with the container 26, as in FIG. 1, the top edge of the container 26 seats in the annular channel 40 against the sealing element 42. The sealing element 42 tends to form a vacuum-tight or hermetic seal with the upper edge of the container 26.

Figure 3A:
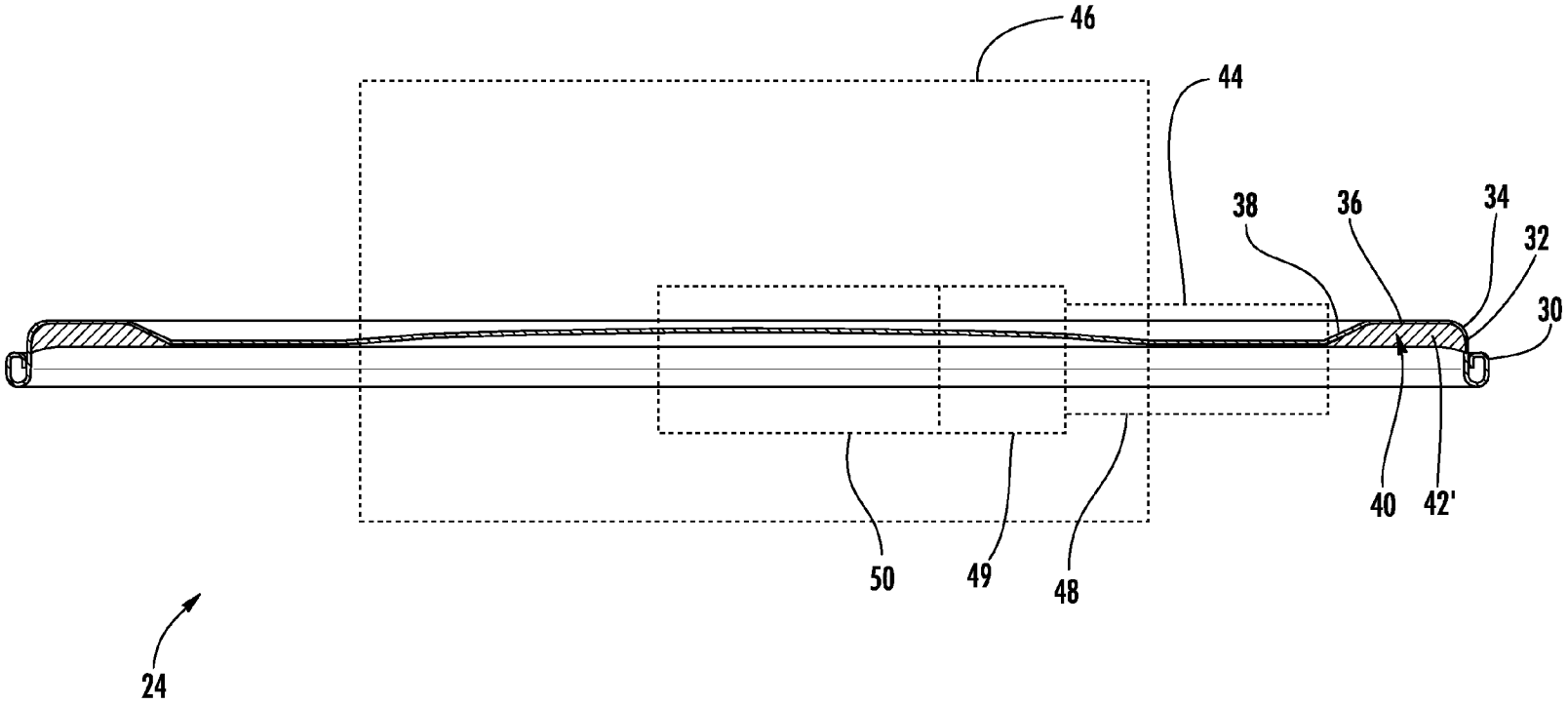
FIG. 3A is a sectional view of an alternate embodiment of the panel illustrated in FIG. 3.

With reference to FIG. 3A, in another embodiment, a sealing element 42' substantially fills the annular channel 40, providing a generally planar, continuous sealing surface proximate the angular transition portion 38 for sealing with the top edge of a container.

With further reference to FIG. 3, extending inwardly from the inner end or edge of the angular transition portion 38 distal from the raised horizontal portion 36 is a generally flat portion 44. The generally flat portion 44 extends inwardly to a raised central portion, shown as raised panel deflector portion 46. The raised panel deflector portion 46 slopes generally upwardly towards a high point at the center of the panel 24. In the embodiment shown in the FIGS., the panel 24 is a generally circular, radially symmetric panel, and the high point of raised panel deflector portion 46 is located at the center of panel 24.

The raised panel deflector portion 46 includes a first, radially outer transition portion 48 having a first slope, a second radially inner transition portion 49 having a second slope and extending radially inwardly from the first transition portion 48 to a central portion, such as a central post portion 50 having a third slope, as will be further described below. In one embodiment, the first, second, and third slopes are different.

Figure 4:
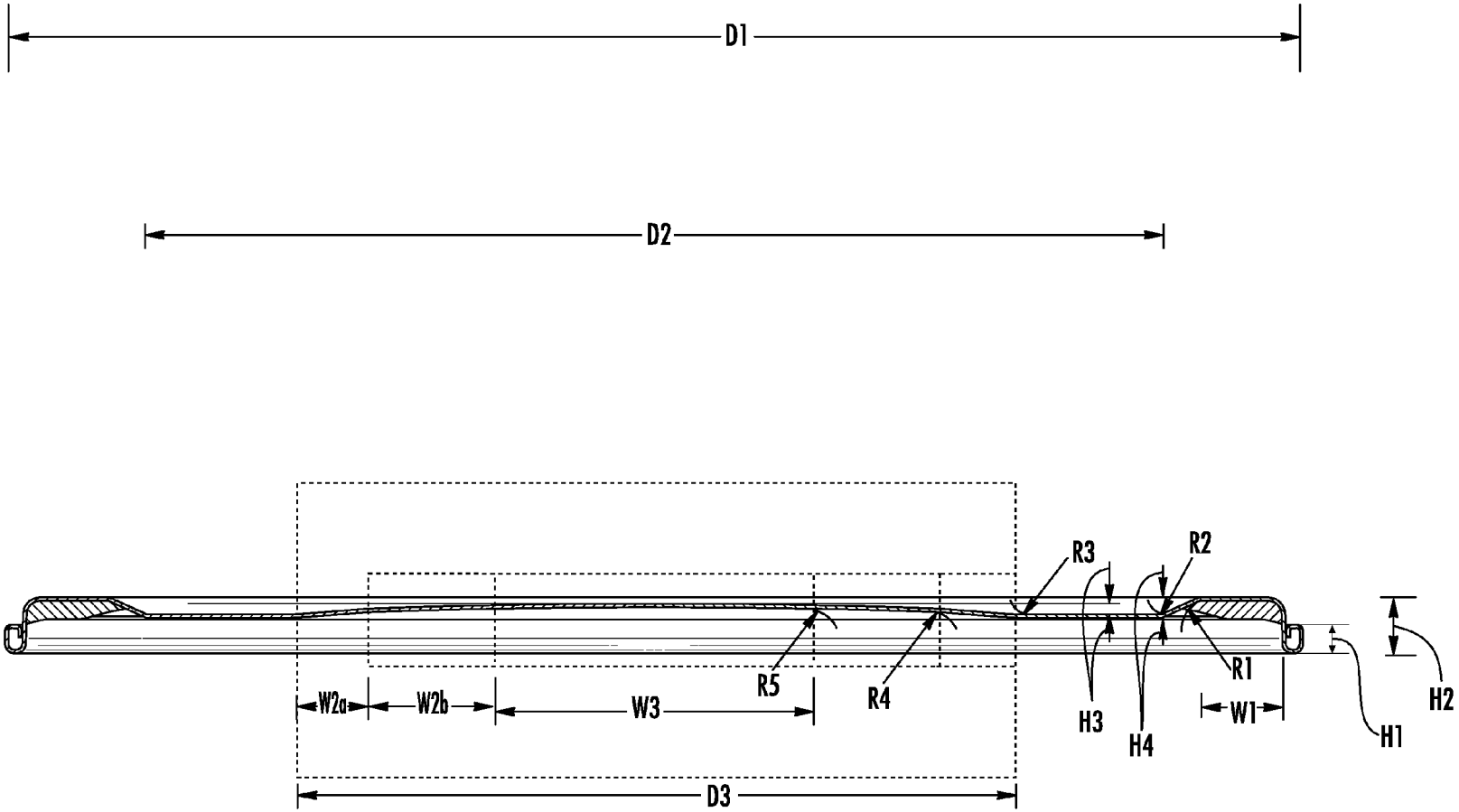
FIG. 4 is the sectional view of FIG. 3 illustrating various dimensions of the panel of the composite closure of FIG. 1 according to an exemplary embodiment.

With reference to FIG. 4, dimensions of an embodiment of panel 24 are shown. The curl 30 extends parallel to the generally vertical wall portion 32 over a vertical height H1. In one embodiment the vertical height H1 is between approximately 0.02 and 0.085 inches. In another embodiment the vertical height H1 is between approximately 0.035 and 0.075 inches. In another embodiment the vertical height H1 is between approximately 0.045 and 0.065 inches. The generally vertical wall portion 32 extends generally perpendicular to the raised horizontal portion 36 over a vertical height H2. In one embodiment the vertical height H2 is between approximately 0.07 and 0.13 inches. In another embodiment the vertical height H2 is between approximately 0.08 and 0.12 inches. In another embodiment the vertical height H2 is between approximately 0.09 and 0.11 inches.

In the illustrated embodiment, the panel 24 is generally circular and has a diameter D1 measured from the exterior of the generally vertical wall portion 32. In one embodiment the diameter D1 is between approximately 2.0 and 3.0 inches. In another embodiment the diameter D1 is between approximately 2.2 and 2.6 inches. In another embodiment the diameter D1 is approximately 2.4 inches. With reference to FIG. 2, the panel 24 is dimensioned to fit within the skirt portion 29 of the outer closure portion 22 and, thus, diameter D1 is generally less than the inner diameter of the skirt portion 29, as will be explained further below.

Returning to FIG. 4, the raised horizontal portion 36 extends generally perpendicular to the generally vertical wall portion 32 and covers a horizontal width W1. In one embodiment the horizontal width W1 is between approximately 0.1 and 0.7 inches. In another embodiment the width W1 is between approximately 0.2 and 0.6 inches. In another embodiment the width W1 is between approximately 0.3 and 0.5 inches.

The first transition portion 48 of the raised panel deflector portion 46 extends between the generally flat portion 44 and the second transition portion 49, as illustrated in FIG. 4, a horizontal width W2*a*. In one embodiment the horizontal width W2*a* is between approximately 0.01 and 0.4 inches. In another embodiment the horizontal width W2*a* is between approximately 0.025 and 0.2 inches. In another embodiment the horizontal width W2*a* is between approximately 0.08 and 0.175 inches.

The second transition portion 49 extends between the radially inner end of the first transition portion 48 to the central post portion 50, as illustrated in FIG. 4, a horizontal width W2*b*. In one embodiment the horizontal width W2*b* is between approximately 0.01 and 0.4 inches. In another embodiment the horizontal width W2*b* is between approximately 0.025 and 0.2 inches. In another embodiment the horizontal width W2*b* is between approximately 0.08 and 0.175 inches.

The central post portion 50 of the panel deflector portion 46 is radially inwardly of the second transition portion 49 and, as illustrated in FIG. 4, extends a horizontal width W3.

The transition portions 48 and 49 extend angularly upwardly from the generally flat portion 44, as will be explained further below. The central post portion 50 of the panel deflector portion 46 extends from the transition portion 49 to the center of the panel 24, as will be explained further below. In one embodiment the horizontal width W3 is between approximately 0.2 and 1.5 inches. In another embodiment the horizontal width W3 is between approximately 0.375 and 1.0 inches. In another embodiment horizontal width W3 is between approximately 0.4 and 0.75 inches. In another embodiment horizontal width W3 is approximately 0.5 inches.

The panel deflector portion 46 extends upwardly above the generally flat portion 44. As illustrated in FIG. 4, at its peak the panel deflector portion 46 is at a vertical height H3 above the generally flat portion 44. In one embodiment the vertical height H3 is between approximately 0.001 and 0.030 inches. In another embodiment the vertical height H3 is between approximately 0.012 and 0.025 inches. In another embodiment the height vertical H3 is between approximately 0.014 and 0.020 inches. The raised horizontal portion 36 extends above the generally flat portion 44. As illustrated in FIG. 4, the raised horizontal portion 36 is at a vertical height H4 above the generally flat portion 44. In one embodiment the vertical height H4 is between approximately 0.025 and 0.085 inches. In another embodiment the vertical height H4 is between approximately 0.03 and 0.075 inches. In another embodiment the vertical height H4 is approximately 0.035 inches.

In one embodiment, the vertical height H3 is between approximately 25% and 100% of the vertical height H4. In another embodiment, the vertical height H3 is between approximately 45% and 100% of the vertical height H4. In another embodiment, the vertical height H3 is between approximately 50% and 55% of the vertical height H4.

In one embodiment the diameter D2 of the panel 24 measured from the coupling location of the angular transition portion 38 to the generally flat portion 44 is between approximately 1.25 and 2.5 inches. In another embodiment, the diameter D2 is between 1.5 and 2.25 inches. In another embodiment, the diameter D2 is between 1.7 and 2 inches.

In one embodiment the panel deflector portion 46 has a diameter D3 between approximately 0.5 and 1.5 inches. In another embodiment the diameter D3 is between approximately 0.75 and 1.0 inches. In another embodiment the diameter D3 is approximately 1.0 inches.

In various embodiments various panels 24 may be formed with various ratios of diameter D3 of the panel deflector portion 46 to the diameter D2 of the panel. In one embodiment the ratio of the diameter D3 to the diameter D2 is between approximately 20% and 90%. In another embodiment the ratio of the diameter D3 to the diameter D2 is between approximately 30% and 85%. In another embodiment the ratio of the diameter D3 to the diameter D2 is between approximately 50% and 80%. In another embodiment the ratio of the diameter D3 to the diameter D2 is between approximately 50% and 60%.

In various embodiments various panels 24 may be formed with various ratios of diameter D3 of the panel deflector portion 46 to diameter D1 of the panel 24 measured from the peripheral edge of the generally vertical wall portion 32. In one embodiment the ratio of the diameter D3 to the diameter D1 is between approximately 20% and 70%. In another embodiment the ratio of the diameter D3 to the diameter D1 is between approximately 30% and 60%. In another embodiment the ratio of the diameter D3 to the diameter D1 is approximately 42%.

With further reference to FIG. 4, the panel 24 provides a radius of curvature R1 at the junction between the angular transition portion 38 and the raised horizontal portion 36. In one embodiment the radius of curvature R1 is between approximately 0.01 and 0.09 inches. In another embodiment the radius of curvature R1 is between approximately 0.025 and 0.075 inches. In another embodiment the radius of curvature R1 is approximately 0.05 inches.

At the junction between the angular transition portion 38 and the generally flat portion 44, the panel 24 has a radius of curvature R2. In one embodiment the radius of curvature R2 is between approximately 0.01 and 0.09 inches. In another embodiment the radius of curvature R2 is between approximately 0.01 and 0.075 inches. In another embodiment the radius of curvature R2 is between approximately 0.015 and 0.03 inches.

At the junction between the generally flat portion 44 and the first transition portion 48, the panel 24 has a radius of curvature R3. In one embodiment the radius of curvature R3 is between approximately 0.01 and 0.09 inches. In another embodiment the radius of curvature R3 is between approximately 0.02 and 0.06 inches. In another embodiment the radius of curvature R3 is approximately 0.04 inches.

At the junction between the first transition portion 48 and the second transition portion 49, the panel 24 has a radius of curvature of R4. In one embodiment the radius of curvature is between approximately 0.005 and 0.06 inches. In another embodiment the radius of curvature R4 is between approximately 0.01 and 0.04 inches. In another embodiment the radius of curvature R4 is approximately 0.025 inches.

At the junction between the second transition portion 49 and the central post portion 50, the panel 24 has a radius of curvature R5. In one embodiment the radius of curvature R5 is between approximately 0.001 and 0.05 inches. In another embodiment the radius of curvature R5 is between approximately 0.005 and 0.02 inches. In another embodiment the radius of curvature R5 is approximately 0.01 inches.

Figure 5:
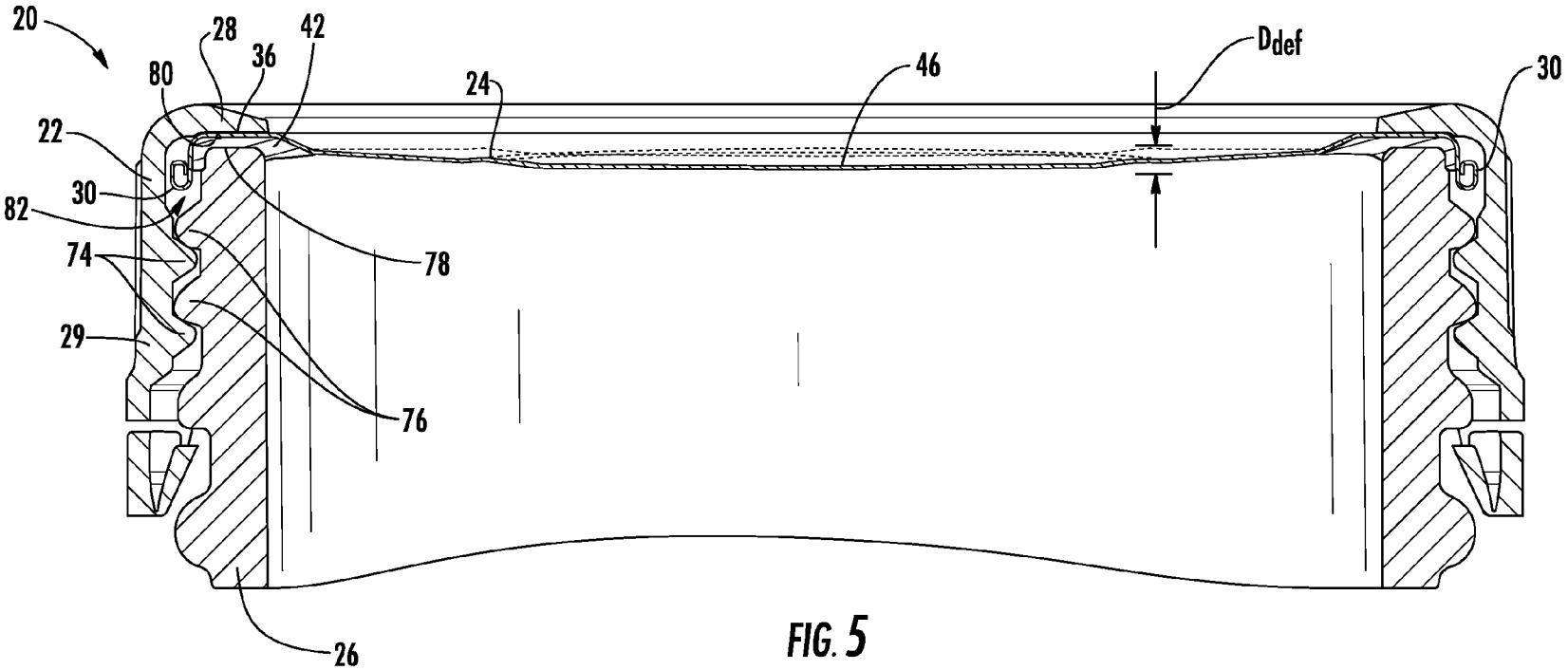
FIG. 5 is a sectional view of the composite closure of FIG. 1 attached to an exemplary container, taken along section line 5-5 in FIG. 1, illustrating the panel displacement when attached to a container under vacuum according to an exemplary embodiment.

FIG. 5 illustrates an embodiment of a composite closure 20 sealing a container 26, the interior of which is under vacuum. As illustrated in FIG. 5, the skirt portion 29 of the outer closure portion 22 defines on its interior wall threading 74. Threading 74 is configured to cooperatively engage with threading 76 defined on the exterior wall of the container 26 to couple the composite closure 20 with the container 26. When the composite closure 20 is coupled with the container 26, the upper edge 78 of the container 26 is disposed against the sealing element 42 creating a vacuum-tight seal between the container 26 and the composite closure 20. The raised horizontal portion 36 of the panel 24 sits adjacent and abuts the underside 80 of the annular top portion 28 of the outer closure portion 22 which, when the composite closure 20 is threaded to the container 26, urges the raised horizontal portion 36 of the panel 24 and the sealing element 42 downwardly against the upper edge 78 of the container 26, helping to provide the vacuum-tight seal between the composite closure 20 and the container 26. A channel 82 is defined by the skirt 29, the underside 80 of the annular top portion 28 and the exterior of the container 26 in which the curl 30 is located.

With further reference to FIG. 5, the location of the panel deflector portion 46 of the panel 24 when the panel 24 is not sealed to a container the interior of which is under vacuum is illustrated in broken lines. When the composite closure 20 is sealed to a container 26 the interior of which is under vacuum, the panel deflector portion 46 of the panel 24 tends to deflect downwardly to a second configuration illustrated in solid lines in FIG. 5. The higher pressure outside the container creates a pressure force differential which tends to cause the center of the panel deflector portion 46 to deflect downwardly toward the lower pressure interior of the container 26 a deflection distance $D_{def}$. The deflection distance $D_{def}$ will depend on several factors including the level of vacuum within the container, the dimensions of the panel deflector portion 46 relative to the panel 24, the shape and relative positions of the sections of panel deflector portion 46, the type of material from which the panel 24 is formed, etc. The vacuum in the interior of the container 26 may be due to a variety of factors, for example, in one embodiment the product added to the interior of the container 26 prior to sealing may be hotter than the ambient temperature. When the contents of the container 26 cool after the container 26 has been sealed, the pressure in the interior of the container 26 will be lower than the exterior ambient temperature.

In one embodiment, the deflection distance $D_{def}$ may be between approximately 0.02 and 0.06 inches. In another embodiment, the deflection distance $D_{def}$ may be between approximately 0.025 and 0.05 inches. In another embodiment, the deflection distance $D_{def}$ may be between approximately 0.03 and 0.045 inches.

In one embodiment, the panel deflector portion may transition between the raised state and the lowered state when attached to a container the interior of which is at a pressure of between 20 and 30 inches of Hg.

Figure 6:
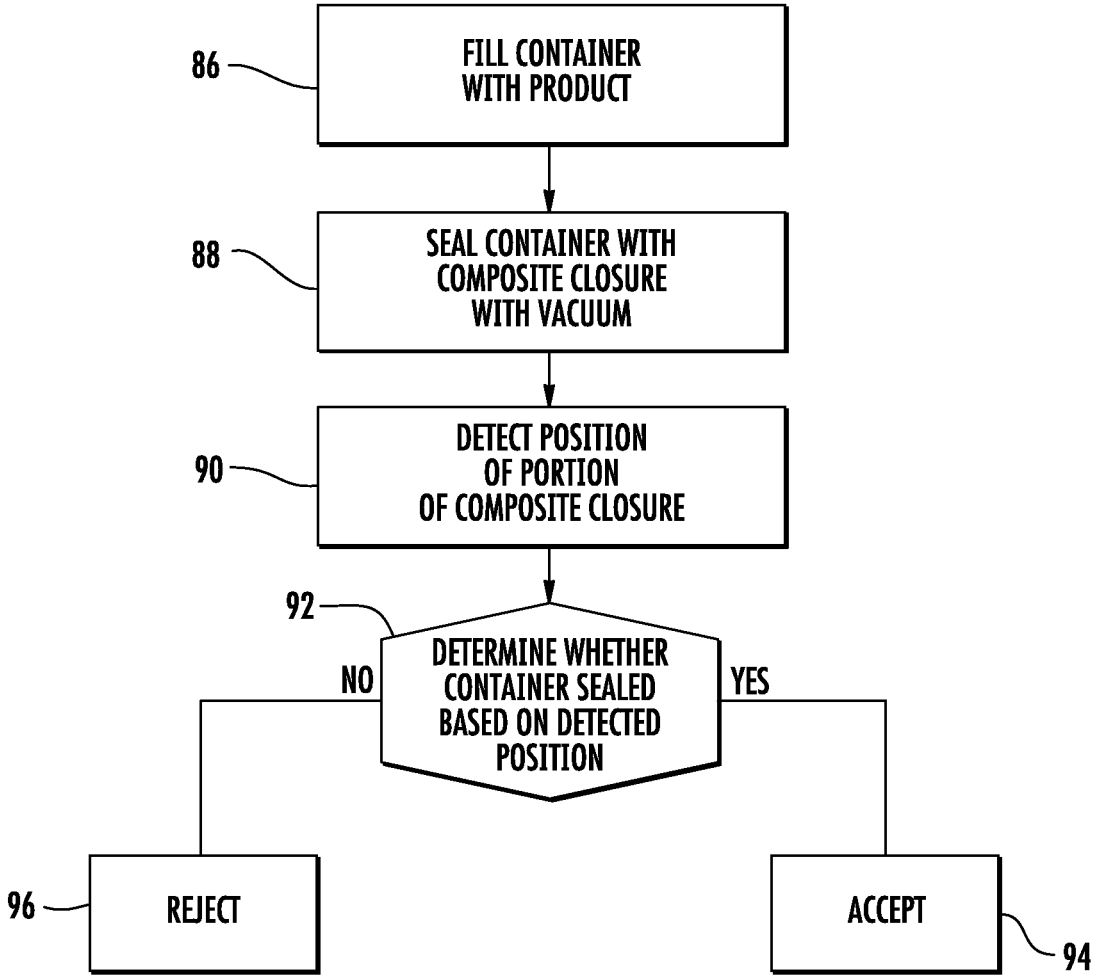
FIG. 6 is a flow diagram illustrating the steps of filling and inspecting the seal of a composite closure according to an exemplary embodiment.

Referring to FIG. 6, a method of utilizing an embodiment of a composite closure 20 is illustrated. At step 86 a container is filed with a product. As described above, in one embodiment, the product may be heated prior to being placed inside container. Additionally or alternatively, the environment in which the product is placed inside the container may be a reduced pressure environment. At step 88 the composite closure 20 is secured to the container 26, sealing the container 26. The composite closure 20 is then inspected for proper sealing. In the embodiment illustrated in FIG. 6, step 90 is performed by sensing the position of the raised panel deflector portion 46 of panel 24. In one embodiment this step is accomplished through the use of a suitable control system configured to control a suitable detector. In one embodiment this step may be accomplished by, for example, electro-optical inspection, electro-magnetic inspection, inspection by a capacitance sensor, inspection by an electronic eye, inspection via image processing of digital image data, or any other suitable type of inspection. In various exemplary embodiments, the position of raised panel deflector portion 46 may be detected by using one or more sensors to identify the spatial location of the panel deflector portion 46, to identify the presence or absence of the panel deflector portion 46 at a particular location, and/or by imaging the panel deflector portion 46 and processing the image data to determine position information.

At step 92, a determination is made regarding whether proper sealing of the container has occurred based upon the position sensed at step 90. If it is determined that the container is sealed properly, the container is accepted at step 94. If it is determined that the container is not properly sealed, the container is rejected at step 96. Following rejection the container may be discarded or resealed.

For example, in one embodiment, the sensor that performs the detection includes an electronic eye that views along a path which would intersect the panel deflector portion 46 of the panel if the composite closure 20 were not properly sealed with the container 26. If the composite closure 20 is properly sealed to the container 26 and the interior of the container 26 is under the proper amount of vacuum, the panel 24 will be deflected sufficiently to move the panel deflector portion 46 out of the line of sight of the electronic eye. Because the electronic eye does not see the panel deflector portion 46, at step 94 the container 26 is properly sealed and accepted. However, if the composite closure 20 is not properly sealed to the container 26 or if the interior of the container 26 is not under the proper amount of vacuum, the panel deflector portion 46 will not be sufficiently deflected out of the view of the electronic eye and the panel deflector 46 will be in the line of sight of the electronic eye. In such case, at step 96 the container 26 will be rejected due to improper sealing. While this inspection method is described with reference to an electronic eye, as noted above, in other embodiments, other sensors and control systems can be used to detect the position of panel deflector 46.

In another embodiment, the height of the panel deflector portion 46 is detected and compared to a reference level. If the detected height of the panel deflector portion 46 is within a proper range relative to the reference level, the container 26 is properly sealed and is accepted. However, if the detected height of the panel deflector portion 46 is not within a proper range relative to the reference level, the container 26 is improperly sealed and is rejected.

In contrast with embodiments of the panel 24 configured as described, panels with different configurations (e.g., panels with panel deflector portion 46 or with raised portions shaped or configured differently than panel deflector portion 46) may perform differently. For example, a substantially flat panel without a central panel deflector portion under approximately 9 inches of Hg vacuum may tend to deflect between approximately 0.020 and 0.023 inches. Under the same level of vacuum, the embodiments of the panel 24 discussed herein may deflect between 0.030 and 0.050 inches. Thus, flat panels tend to deflect under similar levels of vacuum less than panels 24, as described above. Proper levels of deflection may allow for reliable detection of whether composite closures 20 are properly sealed with containers.

Because of the deflection characteristics of embodiments of the composite closure 20, the composite closure 20 tends to deflect by relatively large amounts, even under relatively low vacuum, allowing for accurate inspection, as described above.

As discussed above, in some embodiments it may be desirable to utilize embodiments of composite closures 20 to close containers formed from plastic or other materials. It also may be desirable that the interior of such containers be kept under vacuum. However, containers formed from some materials may have greater deflection characteristics under vacuum than other materials. For example, a container formed from plastic may tend to deflect inwardly under vacuum more than a comparable container formed from, for example, steel or glass. Thus, the interiors of some containers may be able to be put under higher levels of vacuum while deflecting less than a preselected amount than other containers. The vacuum within the container causes the panel deflector portion 46 of the panel 24 to deflect, thus the level of vacuum may affect the deflecting force which is placed on the panel deflector portion 46 of the panel 24.

For example, exemplary glass and plastic (e.g., PET) containers filled with similar amounts of substance (e.g., water, foodstuffs, etc.) at a similar elevated temperature may tend to have different resultant vacuum levels in their interiors upon sealing of the containers and allowing the substance in the interior to decrease in temperature. For example, an exemplary glass container and an exemplary plastic container may be filled with water at 180°. When the containers are sealed and the contents are allowed to cool, the interior of the glass container may be at a vacuum level of 5 inches of Hg, while the interior of the plastic container may be at a vacuum level of 2 inches of Hg.

In one embodiment, the panel deflector portion 46 tends to deflect from the first configuration, illustrated in dotted lines in FIG. 5 to the second configuration, illustrated in solid lines in FIG. 5, at an interior pressure of the container 26 of in one embodiment between approximately 1 and 29 inches of Hg of vacuum, or in another embodiment between approximately 1 and 25 inches of Hg of vacuum, depending on ambient pressure, or in another embodiment at an interior pressure of approximately 8 inches of Hg of vacuum.

Embodiments of the composite closure 20 coupled with a container the interior of which is under a vacuum of between 8 inches of Hg of vacuum and 9 inches of Hg of vacuum have a height $H_3$ (again measured between the peak of the panel deflector portion 46 and the generally flat portion 44, negative heights represent distance downward from the generally flat portion 44) in one embodiment of between approximately −0.01 inches and −0.035 inches, in another embodiment between approximately −0.02 inches and −0.03 inches, and in another embodiment between approximately −0.025 inches and −0.028 inches. Thus, the total deflection of embodiments of the composite closure 20 under a vacuum of between 8 inches of Hg of vacuum and 9 inches of Hg of vacuum in one embodiment is between approximately 0.025 inches and 0.06 inches, and another embodiment between approximately 0.035 inches and 0.045 inches.

In one embodiment, the composite closure 20 may be rotated relative to the container 26 to unscrew the composite closure 20 from the container 26 and open the container 26. When the composite closure 20 is unscrewed, the seal between the composite closure 20 and the container 26 is broken, allowing the interior of the container 26 to return to atmospheric pressure and the panel deflector portion 46 of the panel 24 to return to its original, undeflected configuration.

The panel deflector portion 46 is configured such that it deflects from its original, undeflected position to its deflected position and it returns to its original, undeflected position from its deflected position without the panel 24 having what is known as "snap-through." "Snap-through" is an audible indication of transition by, for example, a panel. In one embodiment, when the panel deflector portion 46 of the panel 24 transitions from the undeflected position to the deflected position or from the deflected position to the undeflected position, the panel 24, including the panel deflector portion 46, does not make a sound loud enough to be heard by the average human ear (e.g., quieter than a whisper).

In one embodiment, the panel 24 of the composite closure 20 transitioning between its undeflected configuration and its deflected configuration or returning from its deflected configuration to its undeflected configuration will cause a sound of between approximately 0 dB and 30 dB, more preferably between approximately 0 dB and 20 dB, more preferably between approximately 0 dB and 10 dB.

The shapes, slopes, angles, radii of curvature of the panel deflector portion 46 provide the panel deflector portion 46 with particular deflection characteristics under the particular vacuum ranges described and the lack of snap-through characteristics. The specific configurations of embodiments of panel deflector portions described provides embodiments of the panels 24 with the performance characteristics described.

Figures 7A, 7B, 7C, 7D:
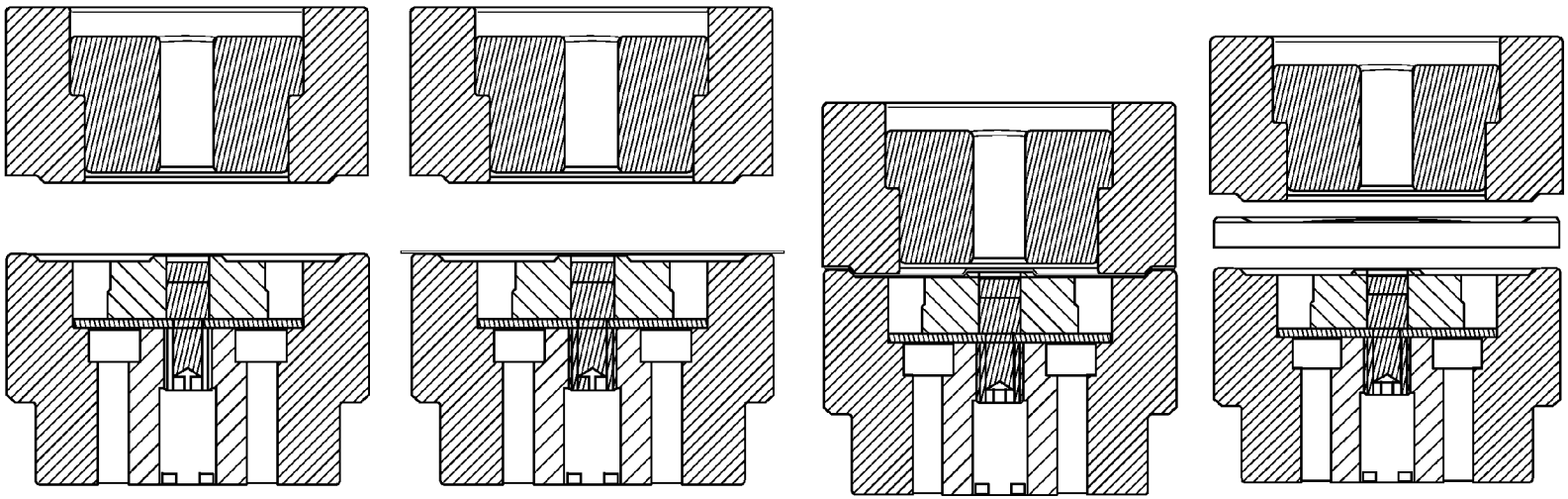
FIGS. 7A-7D are sectional views illustrating an exemplary process for forming an embodiment of a panel of a composite closure.

With reference to FIGS. 7A-7D, an exemplary process for forming an embodiment of a panel with a blanking die is illustrated. FIG. 7A illustrates an open die. FIG. 7B illustrates the material from which the panel will be formed placed in the die. In one embodiment, the material is a metal sheet. The die is suitably shaped to form a panel for a composite closure, such as panel 24 discussed above. FIG. 7C illustrates the panel being stamped. FIG. 7D illustrates the die being opened and the panel being removed. In one embodiment, a peripheral edge is formed into a curl or rolled edge. In one embodiment a circular gasket seal is added to the panel.

Figure 8:
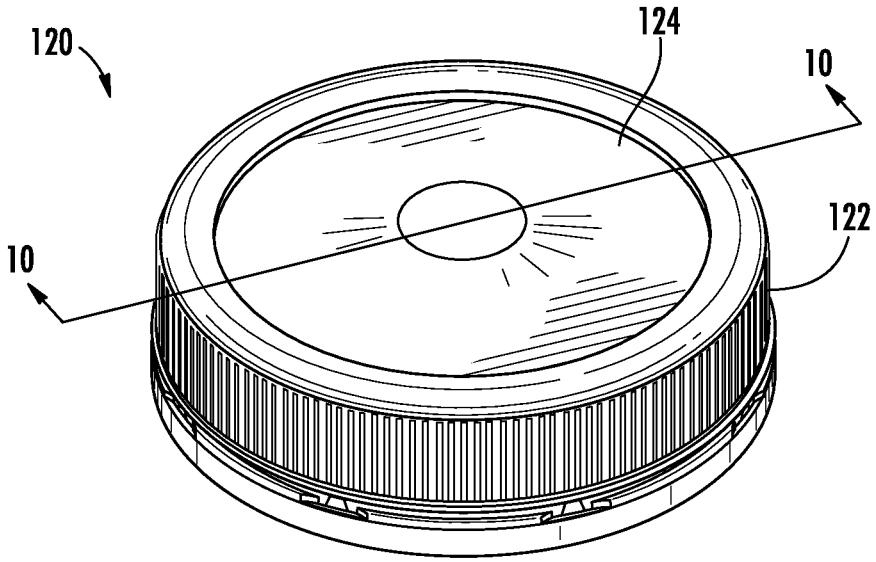
FIG. 8 illustrates a perspective view of another exemplary embodiment of a composite closure.

With reference to FIG. 8, a second embodiment of a composite closure 120 is illustrated. In one embodiment, the composite closure 120 is configured to close containers formed from any suitable type of plastic. In one embodiment, the composite closure 120 is configured to close and seal containers, the interiors of which are kept under vacuum prior to opening the composite closure 120 and breaking the seal with the container. As in the previous embodiment and as will be explained further below, at least a portion of the panel 124 will deflect downwardly towards a container to which it is sealed when the composite closure 120 seals a container the interior of which is under vacuum. The downward deflection of the panel 124 indicates that the composite closure 120 is sealed to the container, that the interior of the container is under vacuum, and that the composite closure 120 has not been opened.

Figure 9:
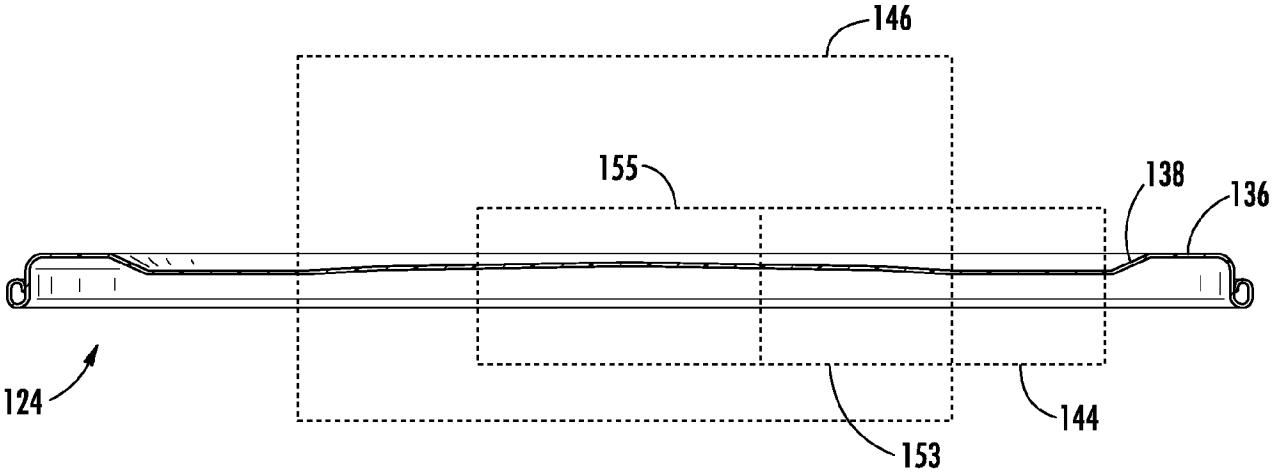
FIG. 9 is a sectional view of the panel of the composite closure of FIG. 8 according to an exemplary embodiment.

With reference to FIG. 9 various portions of the composite closure 120 are described with reference to differences between this embodiment of a composite closure 120 and the embodiment of the composite closure 20 previously described. In FIG. 9 a sectional view of the panel 124 is illustrated. The panel 124 includes an outer annular raised portion, shown as raised horizontal portion 136. Raised horizontal portion 136 extends radially inwardly to an angular transition portion 138. The angular transition portion 138 extends at a non-right angle (i.e., a non-right angle relative to the longitudinal or vertical axis of the closure) radially inward and downward from the raised horizontal portion 136.

Extending radially inwardly from the inner end or edge of the angular transition portion 138 distal from the raised horizontal portion 136 is a generally flat portion 144. The generally flat portion 144 extends radially inwardly to a raised central portion, shown as raised panel deflector portion 146.

The raised panel deflector portion 146 includes a transition portion 153 having a first slope extending radially inwardly to a central portion, such as a central post portion 155. The transition portion 153 extends upwardly towards the central post portion 155 generally at a single angle. The central post portion 155 includes the central point of the panel 124, and is generally radially symmetrical about the central point of the panel 124. The central post portion 155 is also generally the highest portion of the panel 124 radially interior of the generally flat portion 144. In one embodiment, the central post portion 155 slopes generally upwardly to the central point of the panel 124.

Figure 10:
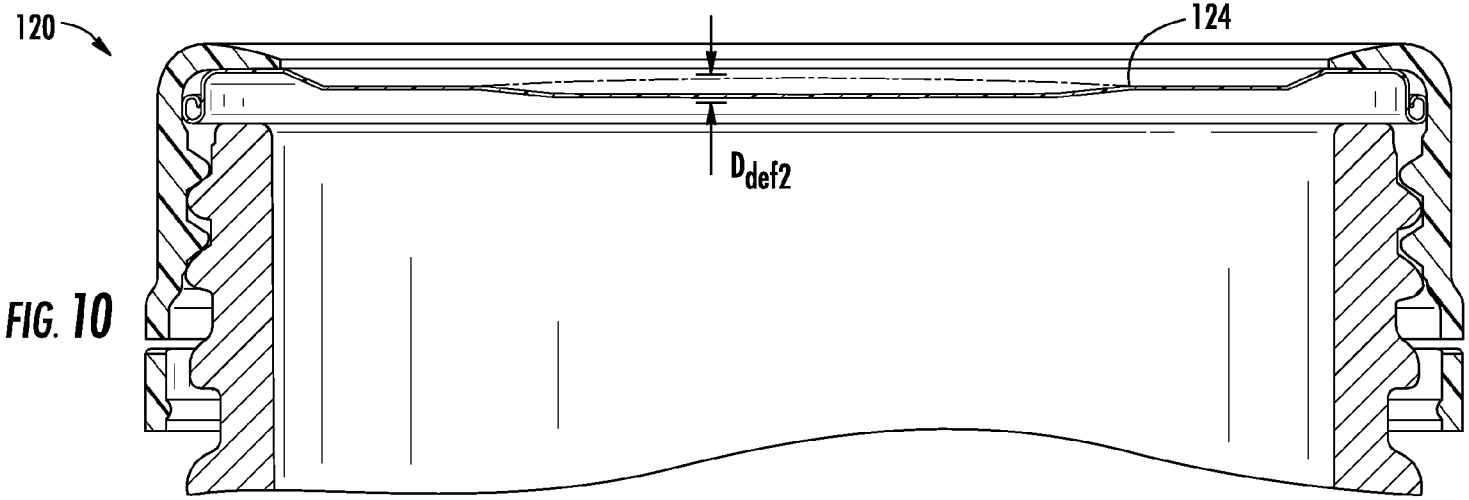
FIG. 10 is a sectional view of the composite closure of FIG. 8, taken along section line 10-10 in FIG. 8, illustrating the panel displacement when attached to a container under vacuum according to an exemplary embodiment.

FIG. 10 illustrates an embodiment of a composite closure 120 sealing a container, the interior of which is under vacuum. The composite closure 120 is coupled with the container sealing the container with a vacuum-tight seal.

With further reference to FIG. 10, the location of the panel deflector portion 146 of the panel 124 when the panel 124 is not sealed to a container the interior of which is under vacuum is illustrated in broken lines. When the composite closure 120 is sealed to a container the interior of which is under vacuum, the panel deflector portion 146 of the panel 24 tends to deflect downwardly to a second configuration illustrated in solid lines in FIG. 10. The higher pressure outside the container creates a pressure force differential which tends to cause the center of the panel deflector portion 146 to deflect downwardly toward the lower pressure interior of the container a deflection distance $D_{def2}$. The deflection distance $D_{def2}$ will depend on several factors including the level of vacuum within the container, the dimensions of the panel deflector portion 146 relative to the panel 124, the shape and relative positions of the sections of panel deflector portion 146, the type of material from which the panel 124 is formed, etc.

In one embodiment, the deflection distance $D_{def2}$ may be between approximately 0.02 and 0.06 inches. In another embodiment, the deflection distance $D_{def2}$ may be between approximately 0.025 and 0.05 inches. In another embodiment, the deflection distance $D_{def2}$ may be between approximately 0.03 and 0.04 inches. In various embodiments, the deflection of the panel deflector portion 146 of the panel 124 may be detectable during processing, as discussed herein. The panel 124 is configured such that the deflection $D_{def2}$ allows for accurate inspection of the composite closure 120 to determine that the composite closure 120 is properly sealed to a container under vacuum.

In another embodiment, when the panel 124 is sealed to a container the interior of which is under 4 inches of Hg of vacuum, the deflection distance deflection distance $D_{def2}$ is between 0.025 inches and 0.026 inches. When the panel 124 is sealed to a container the interior of which is under 6 inches of Hg of vacuum, the deflection distance deflection distance $D_{def2}$ is between 0.030 inches and 0.032 inches. When the panel 124 is sealed to a container the interior of which is under 8 inches of Hg of vacuum, the deflection distance deflection distance $D_{def2}$ is between 0.033 inches and 0.034 inches. When the panel 124 is sealed to a container the interior of which is under 10 inches of Hg of vacuum, the deflection distance deflection distance $D_{def2}$ is between 0.035 inches and 0.036 inches. When the panel 124 is sealed to a container the interior of which is under 12 inches of Hg of vacuum, the deflection distance deflection distance $D_{def2}$ is approximately 0.037 inches.

In one embodiment, the panel deflector portion may transition between the raised position and the lowered position when attached to a container the interior of which is at a pressure of between 20 and 30 inches of Hg.

It should be understood that the present application is not limited to the details or methodology set forth in the description or illustrated in the figures. It should also be understood that the terminology is for the purpose of description only and should not be regarded as limiting.

In one embodiment the annular outer closure portion 22 is formed from plastic, such as, for example, thermoplastic, such as polyethylene, polypropylene, polystyrene, polyvinyl chloride, or polytetrafluoroethylene (PTFE). In other embodiments, other suitable types of plastic and other suitable materials may also be used. In one embodiment, the panel 24 is formed from metal, such as aluminum, steel, or any other suitable type of metal.

Closure of containers formed from other suitable types of materials than plastic may also be accomplished with composite closures 20 and 120.

In one embodiment the sealing element 42 is formed from gasket material. In one embodiment the sealing element 42 includes spin lined material, such as, in one embodiment, plastisol. In another embodiment, the sealing element 42 includes injection molded thermoplastic elastomer (TPE) material, such as, for example, styrenic block copolymers, polyolefin blends, elastomeric alloys (TPE-v or TPV), thermoplastic polyurethanes, thermoplastic copolyester, or thermoplastic polyamides, which may be injection molded into the annular channel 40. The sealing element 42 may be removably, semi-permanently, or permanently retained within the annular channel 40. Other suitable sealing elements may also be used.

In one embodiment, the first slope of the first transition portion 48, the second slope of the second transition portion 49, and the third slope of the central post portion 50 are different. In other embodiments, the first, second, and/or third slopes may be generally the same. In another embodiment, the third slope of the central post portion 50 is generally zero and the central post portion 50 is generally flat.

In one embodiment the central post portion 155 is generally flat.

In one embodiment, the lower pressure in the interior of the container may be due to other factors, such as, for example, the container 26 may also be filled in a reduced pressure environment. Thus, when the container 26 is sealed and brought into a higher ambient pressure environment, the interior of the container 26 will be at a lower pressure than the ambient environment.

In one embodiment, the container 26 may be filled with various different types of food. It should be understood that the phrase "food" may refer to dry food, moist food, powder, liquid, or any other drinkable or edible material, regardless of nutritional value. Additionally, non-food products may placed in the container 26.

In the embodiments illustrated in FIGS. 5 and 10, the panel deflector portions 46 and 146 in their undeflected positions have a generally convex shape, and in their deflected positions have a generally concave shape. In another embodiment, the panel deflector portions 46 and 146 maintain their generally convex shape in the deflected position. The downward deflection of the panel deflector portions 46 and 146 to their deflected positions is provided by downward deflection of the generally flat portions 44 and 144, while the panel deflector portions 46 and 146 are maintained their generally convex shape.

Figure 11:
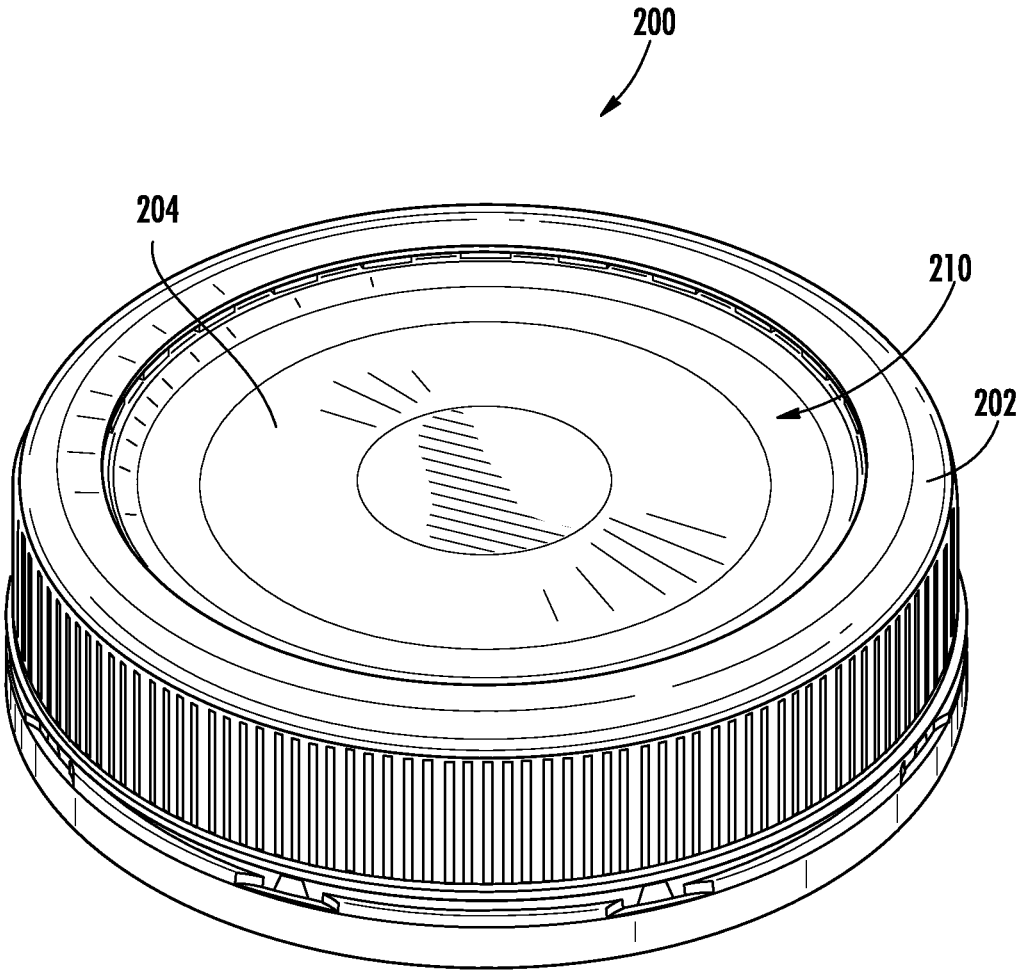
FIG. 11 is a perspective view of an embodiment of a composite closure.

Referring to FIG. 11, an embodiment of a composite closure 200 is illustrated. The composite closure 200 includes an outer closure portion 202 and a panel 204. In one embodiment, the annular outer closure portion 204 is formed from plastic. The composite closure 200, including the outer closure portion 202 and the panel 204, includes some similar features to the composite closure 20. The composite closure 200 is described below with some attention to differences between the composite closure 200 and the composite closure 20. Features of some embodiments of the composite closure 200 not specifically discussed below are the same as features of some embodiments of the composite closure 20 described above.

With further reference to FIG. 11, in one embodiment, the panel 204 includes a raised panel deflector portion 210 that slopes generally upwardly toward a high point at the center of the panel 204. As in the previous embodiment, in one embodiment the panel 204 is a generally circular, radially symmetric panel, and the high point of raised panel deflector portion 210 is located at the center of panel 204. In some embodiments, transitions between the various portions of the panel 204 described below are visible when the composite closure 200 is viewed as shown in the perspective view of FIG. 11. For example, in one embodiment, when viewed as shown in the perspective view of FIG. 11, transitions between the various portions of the panel 204 appear as concentric rings. In one embodiment, when viewed as shown in the perspective view of FIG. 11, transitions between the various portions of the raised panel deflector portion 210 appear as, e.g., three concentric rings.

With reference to FIGS. 11-14, in one embodiment, the outer closure portion 202 includes an upper gripping sidewall portion 206 and a lower tamper-indicating portion 208 coupled to the upper gripping sidewall portion 206. The outer closure portion 202 is configured such that when the closure 200 is coupled to a container, the upper gripping sidewall portion 206 is rotated by a user to detach the upper gripping sidewall portion 206 from the lower tamper-indicating portion 208 as the container is opened. As in the previous embodiment, in one embodiment the outer closure portion 202 includes a skirt portion including threading defined on the interior surface thereof configured to interface with threading of a container to couple the closure 200 to the container.

Figure 12:
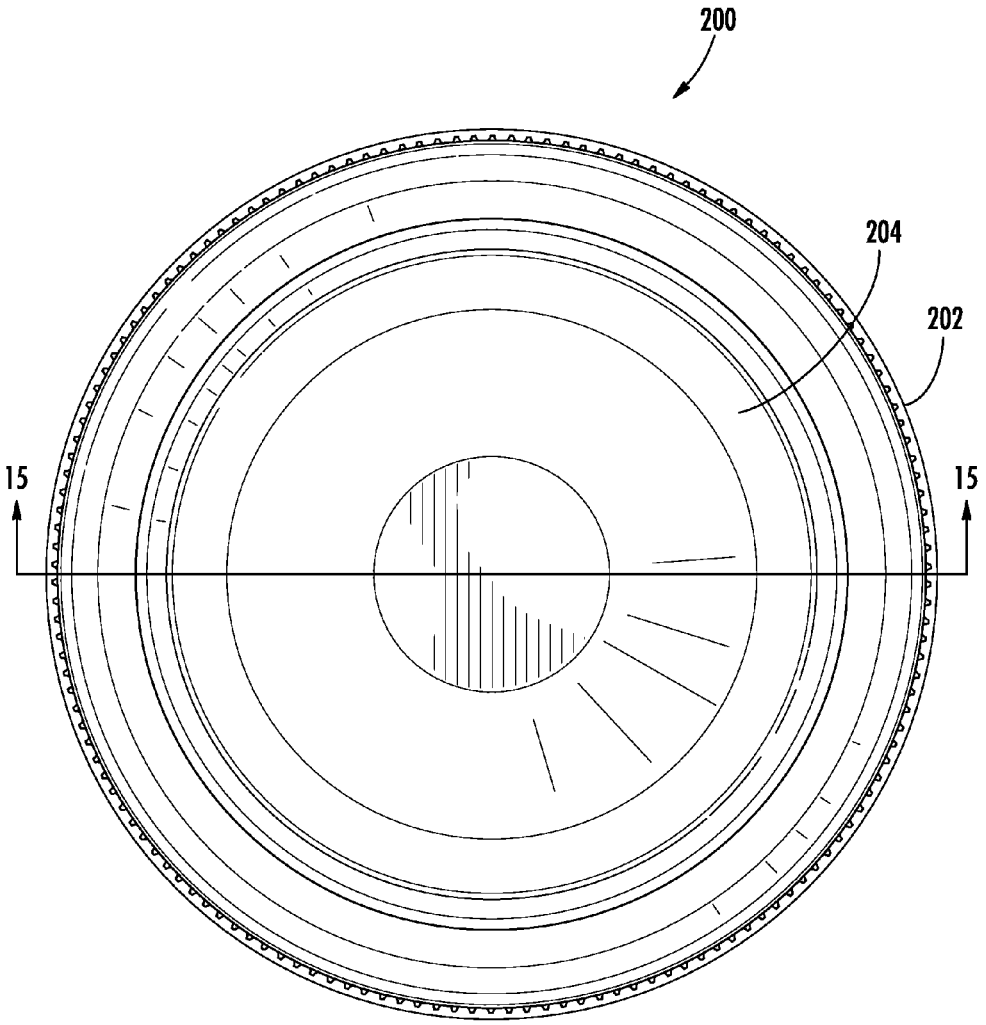
FIG. 12 is a top view of the embodiment of the composite closure of FIG. 11.
Figure 13:
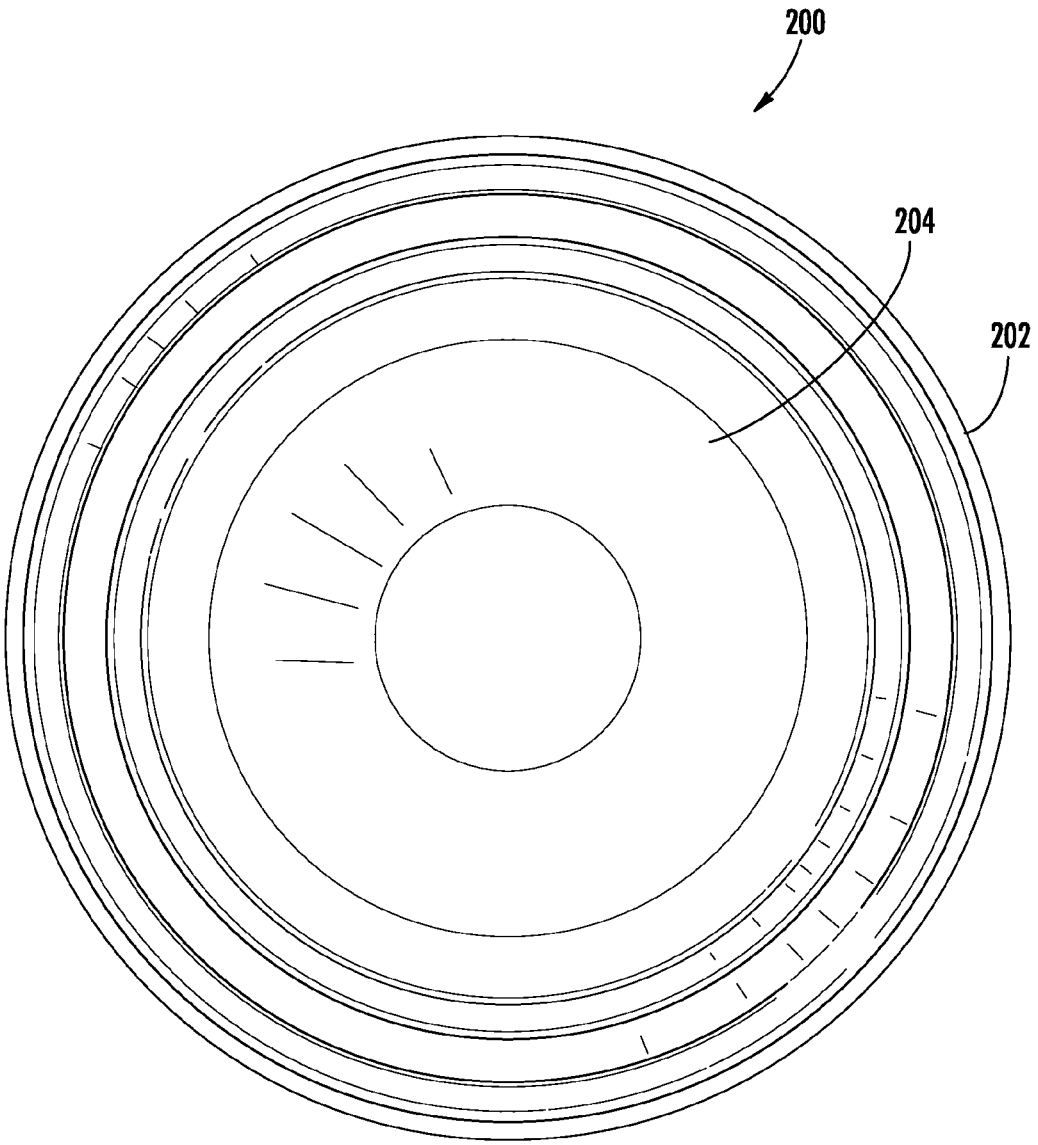
FIG. 13 is a bottom view of an embodiment of a composite closure.
Figure 14:
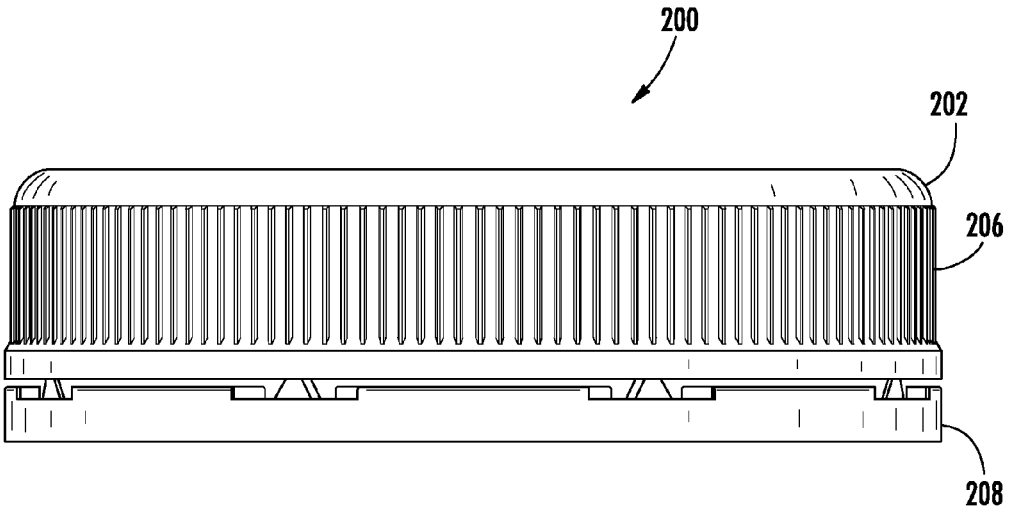
FIG. 14 is a side view of a composite closure.
Figure 15:
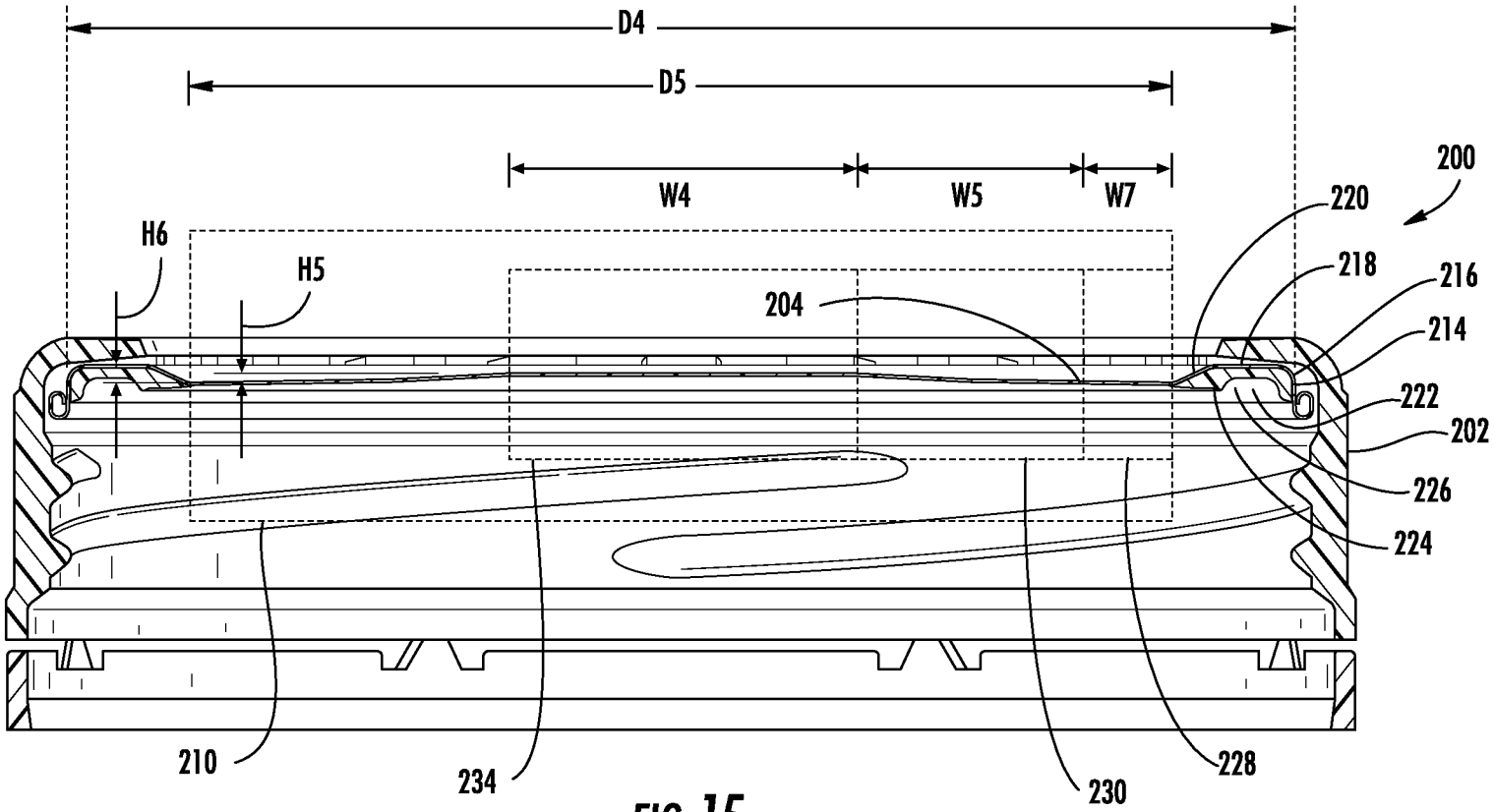
FIG. 15 is a sectional view of an embodiment of a composite closure taken along the line 15-15 in FIG. 12.

With reference to FIG. 15, a sectional view taken along the line 15-15 in FIG. 12 is illustrated. In one embodiment, the panel 204 includes an outer curl configured to interface with the outer closure portion 202 to releasably, semi-permanently, or permanently couple the panel 204 to the outer closure potion 202.

In one embodiment, extending from the outer curl, the panel 204 includes a generally vertical wall portion 214. The generally vertical wall portion 214 extends upwardly away from the curl to a transition portion 216. The transition portion 216 provides a rounded shoulder that extends between the generally vertical wall portion 214 and an outer raised portion, illustrated in FIG. 15 as a raised generally horizontal portion 218. The raised generally horizontal portion 218 extends radially inwardly from the transition portion 216 to an angular transition portion 220. In one embodiment, the angular transition portion 220 extends at a non-right angle (i.e., a non-right angle relative to the longitudinal or vertical axis of the closure) radially inwardly and downwardly from the raised generally horizontal portion 218. The angular transition portion 220, the raised horizontal portion 218, the transition portion 216, and the generally vertical wall portion 214 define a channel 222 on the underside of the panel 204 extending generally around the panel 204 proximate its radial periphery.

In one embodiment, disposed in the channel 222 is a sealing element 224. In one embodiment, the sealing element 224 is coupled to the panel 204 and retained in the channel 222. In one embodiment, the sealing element 224 defines a recessed groove 226. In one embodiment, the recessed groove 226 is shaped, sized, configured, etc., to receive the top edge of a container. In one embodiment, a container is seated in the channel 222 and in the groove 226 against the sealing element 224. In one embodiment, the sealing element 224 is configured to form a vacuum-tight or hermetic seal with the upper edge of a container. In other embodiments, the sealing element 224 does not define a groove and includes a generally flat and continuous sealing surface against which the upper edge of a container forms a vacuum-tight or hermetic seal.

With further reference to FIG. 15, in one embodiment, extending inwardly from the radially inner end of the angular transition portion 220 is the raised panel deflector portion 210. The raised panel deflector portion 210 slopes generally upwardly toward a high point at the center of the panel 204.

In one embodiment, the raised panel deflector portion 210 includes a first, radially outer portion 228 having a first slope extending from the angular transition portion 220 to a second portion 230 located radially inwardly of the first, radially outer portion 228, the second portion 230 having a second slope. In one embodiment, the first slope of the first, radially outer portion 228 is generally flat. The second portion 230 extends radially inwardly from the outer portion 228 to a central portion, shown in FIG. 15 as central post portion 234, having a third slope. In one embodiment, the first, second, and third slopes are different. In another embodiment, the first and third slopes are generally the same and generally different that the second slope. In other embodiments, other suitable configurations of slopes may be provided.

With reference to FIG. 15, dimensions of an embodiment of panel 204 are illustrated. In one embodiment, some of the height dimensions of the panel 204 (e.g., height of curl, height of generally vertical wall portion 214) are generally similar to the height dimensions of the panel 23 above. In one embodiment, the panel 204 is generally circular and has a diameter D4.

In one embodiment, the diameter D4 is measured from the radial periphery of the generally vertical wall portion 214. In one embodiment the diameter D4 is between approximately 2 and 4 inches. In another embodiment the diameter D4 is between approximately 2.2 and 2.6 inches. In another embodiment the diameter D4 is approximately 2.4 inches. In another embodiment, the diameter D4 is between approximately 2.5 inches and 2.7 inches. In another embodiment, the diameter D4 is approximately 2 and ⅔ inches. In another embodiment, the diameter D4 is between approximately 3 inches and approximately 4 inches. In another embodiment, the diameter D4 is approximately 3.14 inches.

As in the previous embodiment described above, in one embodiment, the panel 204 is dimensioned to fit within the skirt portion of the outer closure portion 202 and, thus, diameter D4 is generally less than the inner diameter of the skirt portion.

With further reference to FIG. 15, in one embodiment, the central post portion 234 of the panel deflector portion 210 extends a diameter W4. In one embodiment, the diameter W4 is between approximately 0.3 inches and approximately 1.5 inches. In another embodiment, the diameter W4 is between approximately 0.38 inches and approximately 1.25 inches. In another embodiment, the diameter W4 is between approximately 0.5 inches and approximately 1.0 inches. In another embodiment, the diameter is approximately 0.75 inches.

In one embodiment, the second portion 230 extends a horizontal width W5. In one embodiment, the horizontal width W5 is between approximately 0.1 inches and approximately 0.7 inches. In another embodiment, the horizontal width W5 is between approximately 0.3 inches and approximately 0.5 inches. In another embodiment, the horizontal width W5 is between approximately 0.39 inches and 0.4 inches.

In one embodiment, the first radially outer portion 228 extends a horizontal width W7. In one embodiment, the horizontal width W7 is between approximately 0.01 inches and approximately 0.6 inches. In another embodiment, the horizontal width W7 is between approximately 0.05 inches and approximately 0.3 inches.

The panel deflector portion 210 is a vertical distance H5 proximate the central post portion 234 above the junction between the angular transition portion 220 and the first radially outer portion 228. In one embodiment, the vertical distance H5 is between approximately 0.004 inches and approximately 0.02 inches. In another embodiment, the vertical distance H5 is approximately 0.01 inches.

In one embodiment, the raised generally horizontal portion 218 is a vertical distance H6 above the junction between the angular transition portion 220 and the first radially outer portion 228. In one embodiment, the vertical distance H6 is between approximately 0.025 inches and approximately 0.075 inches. In another embodiment, the vertical distance H6 is approximately 0.035 inches. In another embodiment, the vertical distance H6 is approximately 0.06 inches.

In one embodiment, the vertical height H5 is between approximately 5.3% and 100% of the vertical height H6. In another embodiment, the vertical height H5 is between approximately 20% and 100% of the vertical height H6. In another embodiment, the vertical height H5 is approximately 28.6% of the vertical height H6. In another embodiment, the vertical height H5 is approximately 16.7% of the vertical height of H6.

In one embodiment, the diameter D5 of the panel deflector portion 210 is between approximately 1.5 inches and approximately 2.5 inches. In another embodiment, the diameter D5 of the panel deflector portion 210 is between approximately 1.9 inches and approximately 2.1 inches. In another embodiment, the diameter D5 of the panel deflector portion 210 is approximately 2.03 inches. In another embodiment, the diameter D5 is between approximately 2 inches and approximately 2.5 inches. In another embodiment, the diameter D5 is approximately 2.3 inches. In another embodiment, the diameter D5 is between approximately 2.5 inches and 2.8 inches. In another embodiment, the diameter D5 is approximately 2.7 inches.

In various embodiments various panels 204 may be formed with various ratios of diameter D5 of the panel deflector portion 210 to the diameter D4 of the panel 204. In one embodiment, the ratio of the diameter D5 to the diameter D4 is between approximately 60% and approximately 90%. In another embodiment the ratio of the diameter D5 to the diameter D4 is approximately 85%. In another embodiment the ratio of the diameter D5 to the diameter D4 is approximately 84%. In another embodiment the ratio of the diameter D5 to the diameter D4 is between approximately 82%.

In various embodiments, various panels 204 may be formed with various ratios of diameter W4 of the central post portion 234 to the diameter D5 of the panel deflector portion 210. In one embodiment, the ratio of the diameter W4 to the diameter D5 is between approximately 15% and approximately 70%. In another embodiment the ratio of the diameter W4 to the diameter D5 is between approximately 25% and approximately 50%. In another embodiment the ratio of the diameter W4 to the diameter D5 is approximately 37%. In another embodiment, the ratio of the diameter W4 to the diameter D5 is approximately 34%. In another embodiment, the ratio of the diameter W4 to the diameter D5 is approximately 28%.

In various embodiments, various panels 204 may be formed with various ratios of diameter W4 of the central post portion 234 to the diameter D4. In one embodiment, the ratio of the diameter W4 to the diameter D4 is between approximately 12% and approximately 55%. In another embodiment the ratio of the diameter W4 to the diameter D4 is approximately 31%. In another embodiment, the ratio of the diameter W4 to the diameter D4 is approximately 28%. In another embodiment the ratio of the diameter W4 to the diameter D4 is approximately 24%.

In one embodiment, the central post portion 234 is generally flat. In another embodiment, the central post portion 234 slopes upwardly to a high point proximate the radial center of the central post portion 234.

Figure 15A:
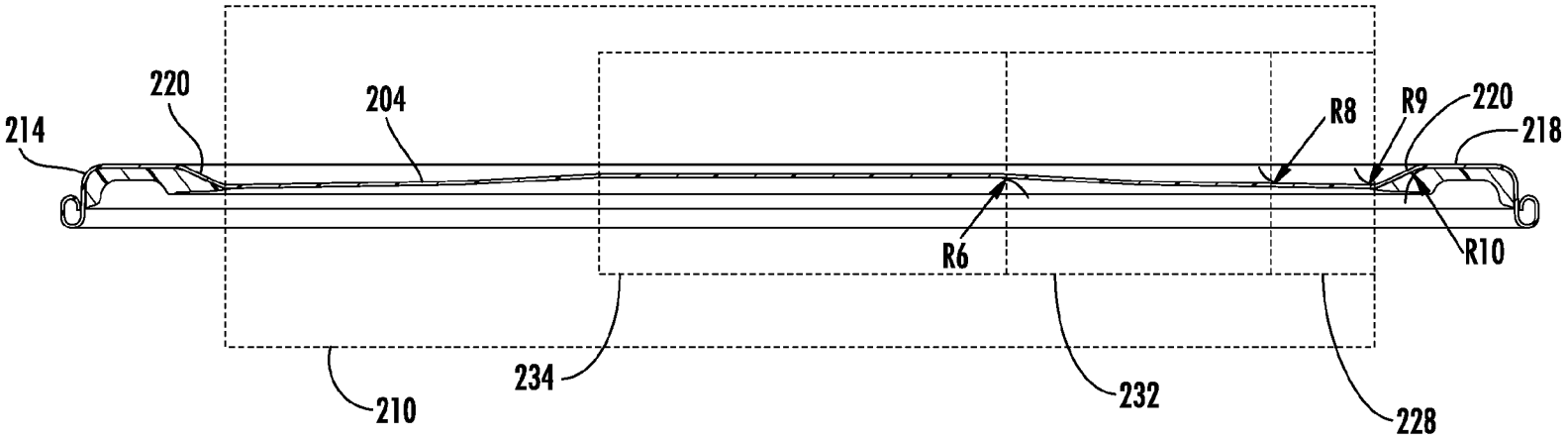
FIG. 15A is the sectional view of FIG. 15 illustrating an embodiment of a panel without an outer closure illustrating various dimensions of the panel of the composite closure of FIG. 11 according to an exemplary embodiment.

With reference to FIG. 15A, in one embodiment, the panel 204 provides a radius of curvature R6 at the junction between the central post portion 234 and the second portion 230. In one embodiment, the radius of curvature R6 is between approximately 0.005 inches and approximately 0.05 inches. In another embodiment, the radius of curvature R6 is approximately 0.025 inches.

In one embodiment, at the junction between the second portion 230 and the first radially outer portion 228, the panel 204 has a radius of curvature of R8. In one embodiment, the radius of curvature R8 is between approximately 0.025 inches and approximately 0.075 inches. In another embodiment, the radius of curvature R8 is approximately 0.055 inches.

In one embodiment, at the junction between the first radially outer portion 228 and the angular transition portion 220, the panel has a radius of curvature of R9. In one embodiment, the radius of curvature R9 is between approximately 0.03 inches and approximately 0.075 inches. In another embodiment, the radius of curvature R9 is approximately 0.055 inches.

With further reference to FIG. 15A, the panel 204 provides a radius of curvature R10 at the junction between the angular transition portion 220 and the raised generally horizontal portion 218. In one embodiment, the radius of curvature R10 is between approximately 0.025 inches and approximately 0.075 inches. In another embodiment, the radius of curvature R10 is approximately 0.03 inches.

Figure 16:
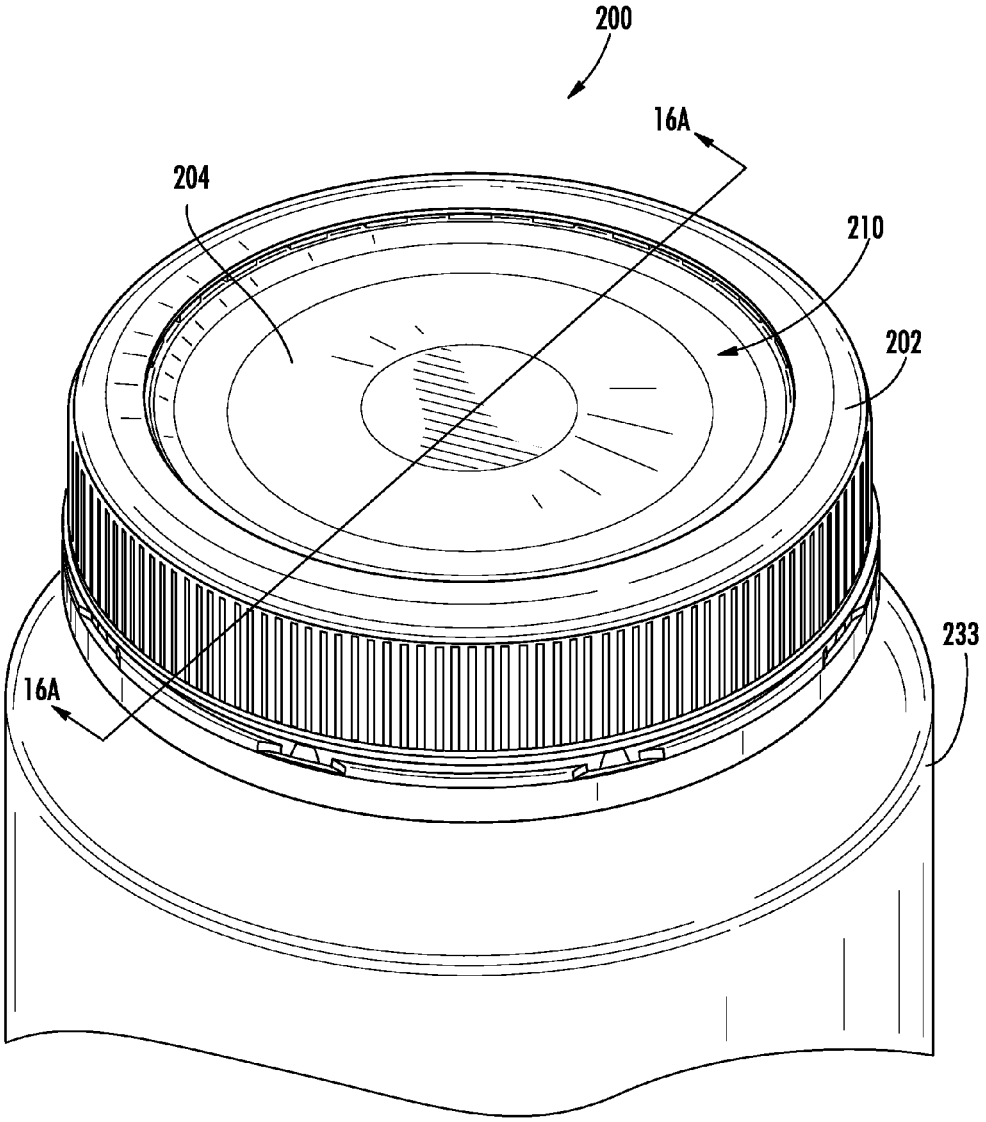
FIG. 16 is a perspective view of an embodiment of a composite closure coupled to a container.

FIG. 16 illustrates an embodiment of a composite closure 200 sealing a container 233, the interior of which is under vacuum (e.g., the pressure within the container 233 is less than the ambient pressure outside the container). As in the previous embodiment, the threading of the composite closure 200 and the threading of the container 233 interact to couple the composite closure 200 to the container 233. When the composite closure 200 is coupled to the container 233, the upper portion of the container 233 is disposed in the groove 226 formed by the sealing element 224 with the upper edge 235 of the container 233 located against the sealing element 224 creating a vacuum-tight seal between the container 233 and the composite closure 200.

Figure 16A:
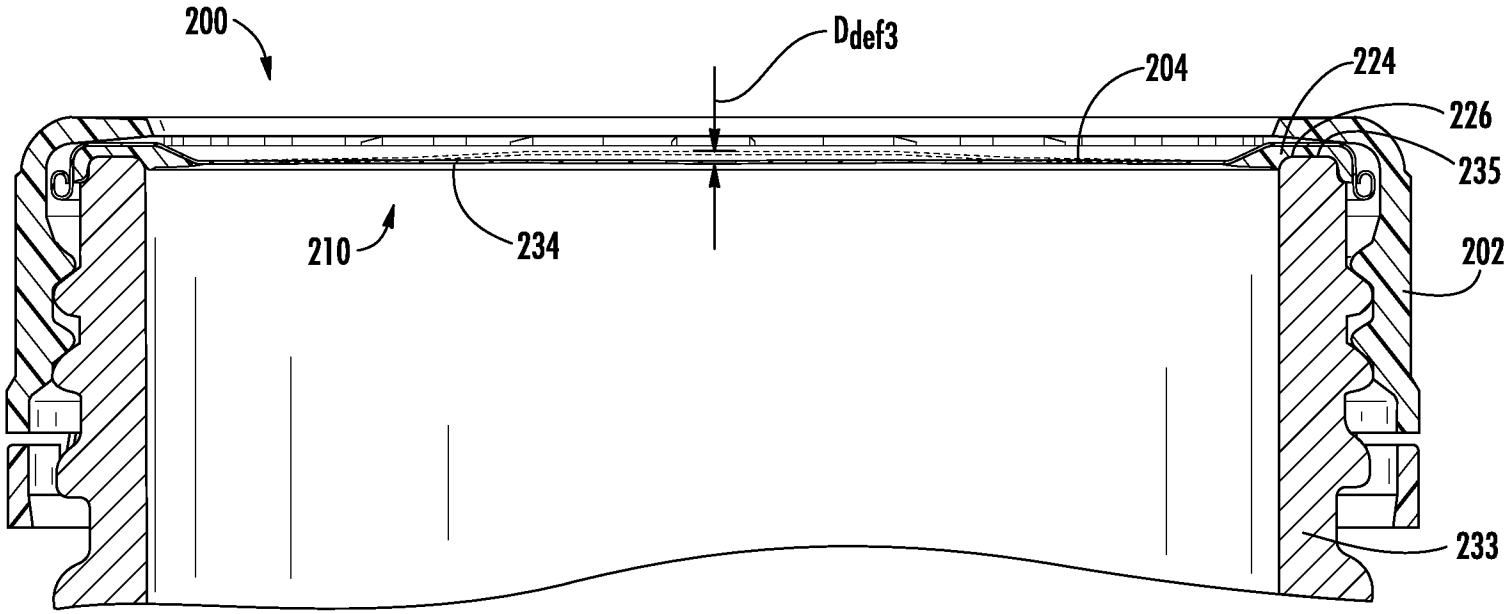
FIG. 16A is a sectional view of an embodiment of a composite closure attached to an exemplary container, taken along the line 16A-16A in FIG. 16 illustrating the panel displacement when attached to a container under vacuum according to an exemplary embodiment.

With further reference to FIG. 16A, the location of the panel deflector portion 210 of the panel 204 when the panel 204 is not sealed to a container the interior of which is under vacuum is illustrated in broken lines. When the composite closure 200 is sealed to a container 233 the interior of which is under vacuum, the panel deflector portion 210 of the panel 204 tends to deflect downwardly to a second configuration illustrated in solid lines in FIG. 16A. The higher pressure outside the container creates a pressure force differential which tends to cause the panel deflector portion 210 to deflect downwardly toward the lower pressure interior of the container 233 a deflection distance $D_{def3}$. The deflection distance $D_{def3}$ will depend on several factors including the level of vacuum within the container, the dimensions of the panel deflector portion 210, the dimensions of the panel deflector portion 210 relative to the dimensions of the rest of the panel 204, the shape and relative positions and dimensions of the various portions of the panel deflector portion 210 (e.g., the dimensions of the central post portion 234 relative to the dimensions of the panel deflector portion 210 as a whole, etc.), the type of material from which the panel 204 is formed, etc.

In various embodiments, as described above with respect to the previous embodiment, the vacuum in the interior of the container 233 may be due to a variety of factors. For example, in one embodiment, the product added to the interior of the container 233 prior to sealing may be hotter than the ambient temperature. When the contents of the container 233 cool after the container 233 has been sealed, the pressure in the interior of the container 233 will be lower than the exterior ambient pressure.

In one embodiment, the deflection distance $D_{def3}$ is between approximately 0.03 inches and approximately 0.05 inches. In another embodiment, the deflection distance $D_{def3}$ is between approximately 0.035 inches and approximately 0.045 inches. In another embodiment, the deflection distance $D_{def3}$ is between approximately 0.04 inches and approximately 0.043 inches. In another embodiment, the deflection distance $D_{def3}$ is approximately 0.041 inches. In one embodiment, the deflection distance $D_{def3}$ is measured at the radial center of the central post portion 234.

In one embodiment, the panel deflector portion may transition between the raised state and the lowered state when attached to a container the interior of which is at a pressure of between approximately 4 inches of Hg and approximately 12 inches of Hg. In another embodiment, the panel deflector portion may transition between the raised state and the lowered state when attached to a container the interior of which is at a pressure of approximately 8 inches of Hg.

As with embodiments of panel 24, panels with different configurations (e.g., panels with panel deflector portions or with raised portions shaped or configured differently than panel deflector portion 210) may perform differently. As discussed above, for example, a substantially flat panel without a central panel deflector portion under approximately 9 inches of Hg vacuum may tend to deflect between approximately 0.020 inches and approximately 0.025 inches. Under the same level of vacuum, the embodiments of the panel 204 discussed herein may deflect between approximately 0.026 inches and approximately 0.043 inches (e.g., measured at the radial center of the panel 204). Thus, flat panels tend to deflect under similar levels of vacuum less than embodiments of panel 204, as described above. Proper levels of deflection may allow for reliable detection of whether composite closures 200 are properly sealed with containers.

In another embodiment, when the panel 204 is sealed to a container the interior of which is under 4 inches of Hg of vacuum, the deflection distance deflection distance $D_{def3}$ is between approximately 0.03 inches and approximately 0.045 inches. In one embodiment, when the panel 204 is sealed to a container the interior of which is under 6 inches of Hg of vacuum, the deflection distance deflection distance $D_{def3}$ is between approximately 0.03 inches and approximately 0.045 inches. In one embodiment, when the panel 204 is sealed to a container the interior of which is under 8 inches of Hg of vacuum, the deflection distance deflection distance $D_{def3}$ is between approximately 0.03 inches and approximately 0.045 inches. In one embodiment, when the panel 204 is sealed to a container the interior of which is under 10 inches of Hg of vacuum, the deflection distance deflection distance $D_{def3}$ is between approximately 0.03 inches and approximately 0.045 inches. When the panel 204 is sealed to a container the interior of which is under 12 inches of Hg of vacuum, the deflection distance deflection distance $D_{def3}$ is approximately 0.041 inches.

Because of the deflection characteristics of embodiments of the composite closure 200, the composite closure 200 tends to deflect by relatively large amounts, even under relatively low vacuum, allowing for accurate inspection, as described above.

As discussed above, in some embodiments it may be desirable to utilize embodiments of composite closures 200 to close containers formed from plastic or other materials. It also may be desirable that the interior of such containers be kept under vacuum. However, containers formed from some materials may have greater deflection characteristics under vacuum than other materials. For example, a container formed from plastic may tend to deflect inwardly under vacuum more than a comparable container formed from, for example, steel or glass. Thus, the interiors of some containers may be able to be put under higher levels of vacuum while deflecting less than a preselected amount than other containers. The vacuum within the container causes the panel deflector portion 210, including, e.g., the central post portion 234, of the panel 204 to deflect, thus the level of vacuum may affect the deflecting force which is placed on the panel deflector portion 210, including the central post portion 234, of the panel 204.

For example, exemplary glass and plastic (e.g., PET) containers filled with similar amounts of substance (e.g., water, foodstuffs, etc.) at a similar elevated temperature may tend to have different resultant vacuum levels in their interiors upon sealing of the containers and allowing the substance in the interior to decrease in temperature. For example, an exemplary glass container and an exemplary plastic container may be filled with water at 180°. When the containers are sealed and the contents are allowed to cool, the interior of the glass container may be at a vacuum level of 5 inches of Hg, while the interior of the plastic container may be at a vacuum level of 2 inches of Hg.

In one embodiment, the panel deflector portion 210 tends to deflect from the first configuration, illustrated in dotted lines in FIG. 16A to the second configuration, illustrated in solid lines in FIG. 16A, at an interior pressure of the container 233 of in one embodiment between approximately 1 inch of Hg of vacuum and approximately 29 inches of Hg of vacuum, or in another embodiment between approximately 1 inch of Hg of vacuum and approximately 25 inches of Hg of vacuum, or in another embodiment between approximately 4 inches of Hg of vacuum and approximately 12 inches of Hg of vacuum, or depending on ambient pressure, or in another embodiment at an interior pressure of approximately 8 inches of Hg of vacuum.

As with the previously described embodiment of a panel deflector portion 46, the panel deflector portion 210 is configured such that it deflects from its original, undeflected position to its deflected position and it returns to its original, undeflected position from its deflected position without the panel 204 having what is known as "snap-through." "Snap-through" is an audible indication of transition by, for example, a panel. In one embodiment, when the panel deflector portion 210 of the panel 204 transitions from the undeflected position to the deflected position or from the deflected position to the undeflected position, the panel 204, including the panel deflector portion 210, does not make a sound loud enough to be heard by the average human ear (e.g., quieter than a whisper).

In one embodiment, the panel 204 of the composite closure 200 transitioning between its undeflected configuration and its deflected configuration or returning from its deflected configuration to its undeflected configuration will cause a sound of between approximately 0 dB and 30 dB, more preferably between approximately 0 dB and 20 dB, more preferably between approximately 0 dB and 10 dB.

In one embodiment, the sound levels above may be emitted by embodiments of panels upon, for example, normal opening of containers to which embodiments of closures are coupled, e.g., normal rotating of the closure relative to the container under normal ambient conditions, e.g., without breaking container, etc.

The shapes, slopes, angles, radii of curvature of embodiments of the panel 204 including those of the panel deflector portion 210, provide the panel deflector portion 210 with particular deflection characteristics under the particular vacuum ranges described and the lack of snap-through characteristics. The specific configurations of embodiments of panel deflector portions described provide embodiments of the panels 204 with the performance characteristics described.

Figure 17A:
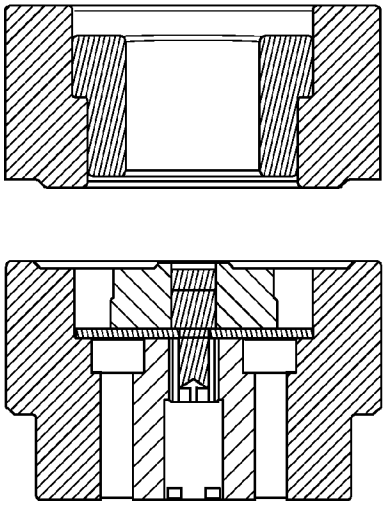
FIGS. 17A-17D are sectional views illustrating an exemplary process for forming an embodiment of a panel of a composite closure.
Figure 17B:
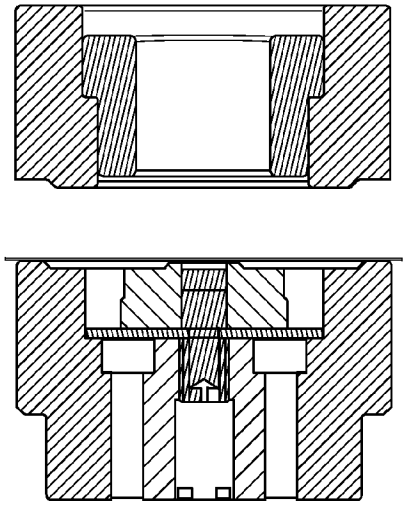
Figure 17C:
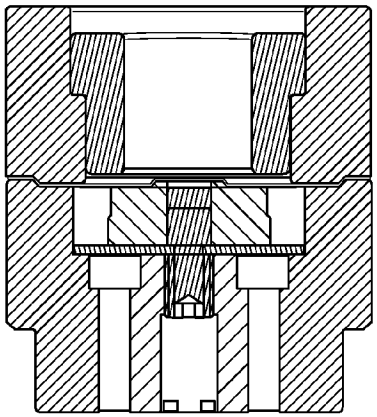
Figure 17D:
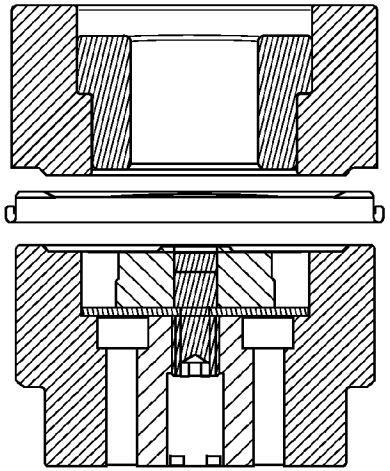

Embodiments of the panel 204 may be formed by similar processes as those described above with respect to other embodiments of panels. With reference to FIGS. 17A-17C, an exemplary process and apparatus for forming an embodiment of a panel 204, e.g., with a die, etc., is illustrated. FIG. 17A illustrates an open die. In the illustrated embodiment, the upper portion of the die has an open central portion with a diameter greater than the diameter of the open central portion of the upper portion of the die illustrated in FIG. 7A. In one embodiment, the diameter of the open central portion of the upper portion of the die has a diameter greater than the diameter W4 of the central post portion 234. FIG. 17B illustrates material from which an embodiment of a panel will be formed located relative to the die. In one embodiment, the die is configured, sized, shaped, etc., to form a panel for a composite closure, such as panel 204, as described above. FIG. 17C illustrates the panel being stamped. FIG. 17D illustrates the die being opened and the panel being removed. In one embodiment, the die forms a the peripheral curl of the panel. In one embodiment, a circular gasket seal is added to the panel. In other embodiments, embodiments of panels may be formed by other suitable processes.

For purposes of this disclosure, the term "coupled" means the mechanical joining of two components directly or indirectly to one another. Such joining may be stationary in nature or moveable in nature. Such joining may be achieved with the two components and any additional intermediate members being integrally formed as a single unitary body with one another or the two components and any additional member being attached to one another. Such joining may be permanent in nature or alternatively be removable or releasable in nature.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Other substitutions, modifications, changes and omissions may also be made in the design, operating conditions and arrangement of the various exemplary embodiments without departing from the scope of the present invention.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

Containers discussed herein may include containers of any style, shape, size, etc. For example, the containers discussed herein may be shaped such that cross-sections taken perpendicular to the longitudinal axis of the container are generally circular. However, in other embodiments the sidewall of the containers discussed herein may be shaped in a variety of ways (e.g., having other non-polygonal cross-sections, as a rectangular prism, a polygonal prism, any number of irregular shapes, etc.) as may be desirable for different applications or aesthetic reasons. In various embodiments, sidewalls of containers may include one or more axially extending sidewall sections that are curved radially inwardly or outwardly such that the diameter of the can is different at different places along the axial length of the can, and such curved sections may be smooth continuous curved sections. In one embodiment, containers may be hourglass shaped. Embodiments of containers may be of various sizes (e.g., 3 oz., 8 oz., 12 oz., 15 oz., 28 oz, etc.) as desired for a particular application.

The containers discussed herein may be used to hold perishable materials (e.g., food, drink, pet food, milk-based products, etc.). It should be understood that the phrase "food" used to describe various embodiments of this disclosure may refer to dry food, moist food, powder, liquid, or any other drinkable or edible material, regardless of nutritional value. In other embodiments, the containers discussed herein may be used to hold non-perishable materials or non-food materials. In various embodiments, the containers discussed herein may contain a product that is packed in liquid that is drained from the product prior to use. For example, the containers discussed herein may contain vegetables, pasta or meats packed in a liquid such as water, brine, or oil.

During certain processes, containers are filled with hot, pre-cooked food then sealed for later consumption, commonly referred to as a "hot fill process." As the contents of the container cool, the pressure within the sealed container decreases such that there is a pressure differential (i.e., internal vacuum) between the interior of the container and the exterior environment. This pressure difference, results in an inwardly directed force being exerted on the sidewall of the container and on the end walls of the container. During other processes, containers are filled with uncooked food and are then sealed. The food is then cooked to the point of being commercially sterilized or "shelf stable" while in the sealed container. During such a process, the required heat and pressure may be delivered by a pressurized heating device or retort.

What is claimed is:

1. A composite closure configured to seal a container defining an interior under vacuum, the composite closure comprising:

an outer section including an annular top portion and a skirt coupled to and extending downward from the annular top portion, the skirt having an interior surface, an exterior surface and at least one securement element extending from the interior surface; and a panel configured to be received within the outer section, the panel including:

an annular raised portion;

an angular portion extending radially inwardly from the annular raised portion along a first transition; and a central deflection portion including:

an outer portion extending radially inwardly from the angular portion along a second transition; and a raised central portion located at a height generally above a height of the outer portion and extending radially inwardly from the outer portion along a third transition;

wherein the first transition defines a radius of curvature between approximately 0.025 and approximately 0.09 inches, the second transition defines a radius of curvature between approximately 0.01 and approximately 0.075 inches, and the third transition defines radius of curvature between approximately 0.02 and approximately 0.06 inches; and wherein the central deflection portion is configured to move downwardly a distance between approximately 0.02 and approximately 0.06 inches from a first position to a second position when the composite closure seals the container with an internal vacuum of at least 9 inches of Hg.

2. The composite closure of claim 1, wherein the central deflection portion is configured to transition from the second position to the first position without snap-through.

3. The composite closure of claim 1, wherein, when the central deflection portion moves from the second position to the first position, the transition causes a sound of between 1 dB and 15 dB.

4. The composite closure of claim 1, wherein the raised central portion is displaced a distance of at least 0.030 inches when the composite closure is attached to a container, the contents of which are under a vacuum of less than 20 inches of Hg.

5. The composite closure of claim 1, wherein the panel has a first diameter measured from the peripheral edge of the annular raised portion;

wherein the raised central portion has a second diameter measured; and wherein the ratio of the second diameter to the first diameter is between 40% and 70%.

6. The composite closure of claim 5, wherein the ratio of the second diameter to the first diameter is between 50% and 60%.

7. The composite closure of claim 1, wherein the raised central portion is configured to deflect from the first position to the second position when the closure is sealed to a container having an internal vacuum of about 10 inches of Hg or less.

8. The composite closure of claim 7, wherein the raised central portion is configured to move to the second position when the closure is sealed to a container having an internal vacuum of about 8 inches of Hg.

9. The composite closure of claim 1, wherein the distance between the raised central portion in the first position and the raised central portion in the second position is at least 0.030 inches.

10. The composite closure of claim 1, wherein the distance between the raised central portion in the first position and the raised central portion in the second position is at least 0.040 inches.

11. A composite closure configured to seal a container having an interior under vacuum, the composite closure comprising:

an outer portion formed from a first material including a skirt extending generally downward from a ring, the skirt having an interior surface and an exterior surface and defining threading on the interior surface configured to threadingly engage the container;

a panel formed from a second material comprising:

a raised outer portion proximate the radial exterior of the panel;

a first sloped portion coupled to and arranged radially inwardly from the raised portion; and a raised central portion coupled to, configured above and radially inwardly from the first sloped portion;

wherein the panel has a first diameter measured at the radial peripheral edge of the first sloped portion;

wherein the raised central portion has a center point, a radially outer peripheral edge, and a second diameter measured at the radially outer peripheral edge of the raised central portion;

wherein ratio of the second diameter to the first diameter is between approximately 30% and approximately 80%;

wherein the center of the raised central portion is arranged at least approximately 0.01 inches vertically above the radial outer peripheral edge of the first sloped portion; and wherein the panel is configured such that the raised central portion is configured to deflect downwardly to a second position when the composite closure is sealed to a container, the interior of which is under vacuum of at least approximately 8 inches of Hg;

wherein the center point of the raised central portion in the second position being configured at least approximately 0.025 inches vertically downwardly from the center point of the raised central portion in the first position.

12. The composite closure of claim 11, wherein the first material is plastic;

wherein the second material is metal;

wherein the panel includes an outer transition portion extending angularly downwardly and radially inwardly from the raised outer portion to the first sloped portion; and wherein the panel further includes a second sloped portion extending radially inwardly from the first sloped portion to the raised central portion, the first sloped portion having a first slope, the second sloped portion having a second slope, the first slope being different from the second slope.

13. The composite closure of claim 11, wherein the panel includes a generally vertical outer wall portion extending downwardly from a peripheral edge of the raised outer portion;

wherein the panel defines a third diameter measured from the generally vertical outer wall portion; and wherein the ratio of the second diameter to the third diameter is between 30% and 60%.

14. The composite closure of claim 11, wherein the panel is configured such that when the raised central portion moves from the first position to the second position or from the second position to the first position the raised central portion does not have snap-through.

15. The composite closure of claim 11, wherein the panel is configured such that when the raised central portion returns from the second position to the first position upon normal opening of the container the panel makes a sound of no more than 20 dB.

16. A composite closure configured to seal a container defining an interior under vacuum, the composite closure comprising:

an outer section including an annular top portion and a skirt coupled to and extending downward from the annular top portion, the skirt having an interior surface, an exterior surface and one or more securement elements extending from the interior surface;

a panel configured to be received within the outer section, the panel including:

an annular raised portion;

a transition portion extending radially inward from the annular raised portion; and a central deflection portion including:

an outer section extending radially inwardly from the transition portion; and a raised central portion extending radially inwardly from and above the outer section, the raised central portion comprising a first section, a second section located radially inwards from the first section, and a central section located radially inwards from the second section;

a first distance as measured between an outermost periphery of the first section and an outermost periphery of the second section being between approximately 0.025 and approximately 0.20 inches;

a second distance as measured between the outermost periphery of the second section and an outermost periphery of the central section being between approximately 0.025 and approximately 0.20 inches;

the diameter of the central section being between approximately 0.4 and approximately 0.75 inches; and a junction defined between the transition portion and the outer section of the central deflection portion;

wherein the central deflection portion is configured to move downwardly from a first position to a second position when the composite closure seals the container with an internal vacuum;

a center point of the central section being located a height of between approximately 0.01 and approximately 0.03 inches above the junction when the central deflection portion is in the first position; and the center point of the central deflection portion being located a height of between approximately 0.02 and 0.06 inches below the junction when the central deflection portion is in the second position.

17. A composite closure configured to seal a container defining an interior under vacuum, the composite closure comprising:

an outer section including an annular top portion and a skirt coupled to and extending downward from the annular top portion, the skirt having an interior surface, an exterior surface and one or more preformed securement elements extending from the interior surface; and a panel configured to be received within the outer section, the panel defining a first diameter and including:

an annular raised portion;

an angular transition portion extending radially inwardly from the annular raised portion, an innermost portion of the angular transition portion defining a second diameter;

a central deflection portion including:

an outer portion located radially inwardly from the angular transition portion; and a raised central portion located inwardly from and generally above the outer portion;

an outermost portion of the central deflection portion defining a third diameter of between approximately 0.5 inches and approximately 1.5 inches;

a ratio between the third diameter and the first diameter being between approximately 30% and approximately 60%; and a ratio between the third diameter and the second diameter being between approximately 30% and approximately 85%;

wherein a center point of the central deflection portion is configured to move downwardly by at least approximately 0.025 inches from a first position to a second position when the composite closure is sealed to a container having an interior which is under a vacuum of at least approximately 8 inches of Hg.

* * * * *